US005746187A

United States Patent [19]

Ninomiya et al.

[11] Patent Number: 5,746,187

[45] Date of Patent: May 5, 1998

[54] AUTOMOTIVE ENGINE CONTROL SYSTEM

[75] Inventors: Hiroshi Ninomiya; Tetsushi Hosokai, both of Hiroshima, Japan

[73] Assignee: Mazda Motor Corporation, Hiroshima, Japan

[21] Appl. No.: 695,600

[22] Filed: Aug. 12, 1996

[30] Foreign Application Priority Data

Aug. 11, 1995 [JP] Japan ..... 7-205578

[51] Int. Cl.[6] ..... F02M 41/00; F02M 33/02

[52] U.S. Cl. ..... 123/520; 123/698

[58] Field of Search ..... 123/518–520, 123/680, 681, 682, 683, 684, 698, 687

[56] References Cited

U.S. PATENT DOCUMENTS

| | | | |
|---|---|---|---|
| 5,353,770 | 10/1994 | Osanai et al. | 123/520 |
| 5,469,832 | 11/1995 | Nemoto | 123/519 |
| 5,469,833 | 11/1995 | Hara et al. | 123/698 |
| 5,520,160 | 5/1996 | Aota et al. | 123/520 |
| 5,524,600 | 6/1996 | Wild | 123/698 |
| 5,546,917 | 8/1996 | Osanai et al. | 123/698 |
| 5,558,072 | 9/1996 | Harima et al. | 123/698 |
| 5,572,980 | 11/1996 | Nakagawa et al. | 123/520 |
| 5,609,142 | 3/1997 | Osanai | 123/520 |

FOREIGN PATENT DOCUMENTS

| | | |
|---|---|---|
| 62-7379 | 2/1987 | Japan . |
| 2-245441 | 10/1990 | Japan . |

*Primary Examiner*—Thomas N. Moulis

*Attorney, Agent, or Firm*—Sixbey, Friedman, Leedom & Ferguson, PC; Gerald J. Ferguson, Jr.; Donald R. Studebaker

[57] ABSTRACT

An engine control system computes an average value for an air-to-fuel feedback control based on which the amount of fuel vapors trapped in a canister, a purge air flow rate on the basis of a pressure difference between before and after a canister purge valve and a duty ratio at which the canister purge valve is activated, the amount of purged fuel vapors on the basis of the estimated trapped fuel vapor amount and purge air flow rate based on which the amount of fuel vapors entering into the combustion chamber. During execution of a canister purge, the purged gas flow rate is gradually varied toward a target rate so as to prevent the air-to-fuel feedback control from encountering disturbances.

10 Claims, 13 Drawing Sheets

FIG.11
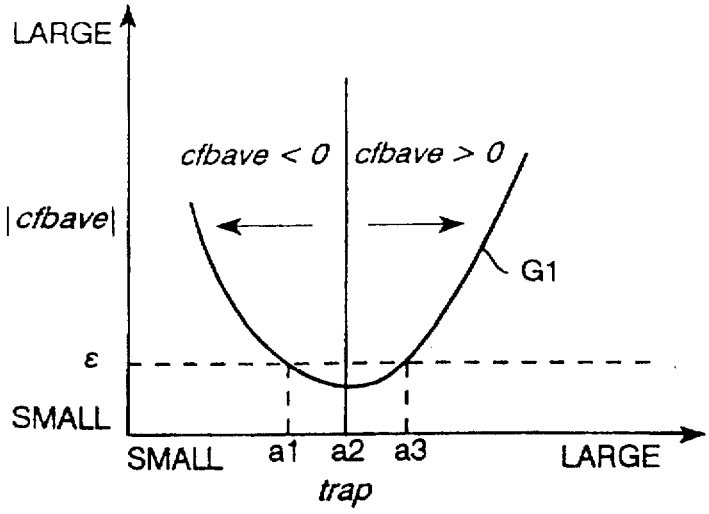
FIG.12A
FIG.12B
FIG.12C
FIG.12D
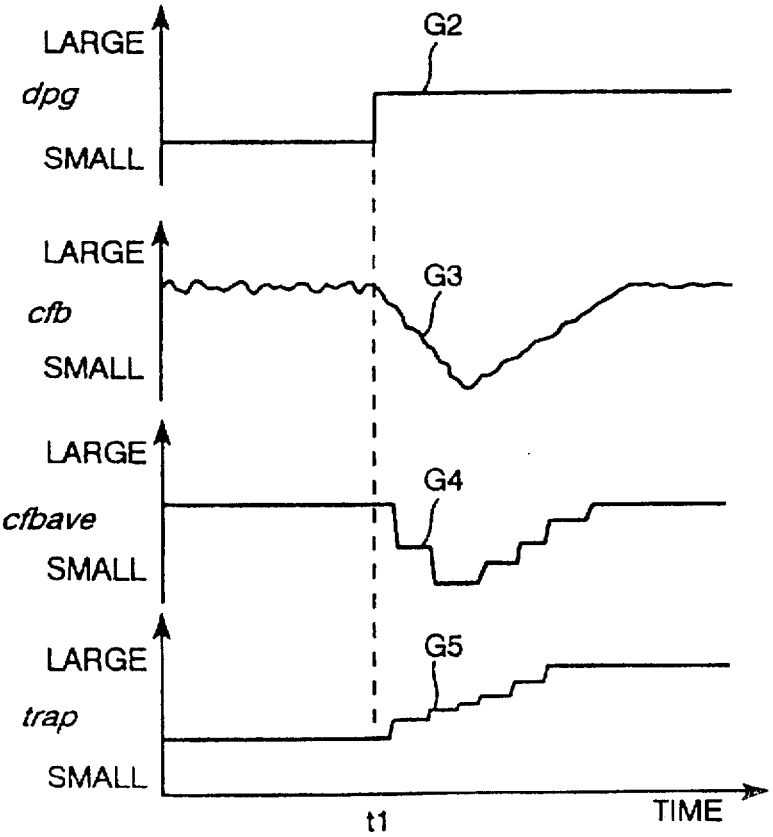

FIG. 13
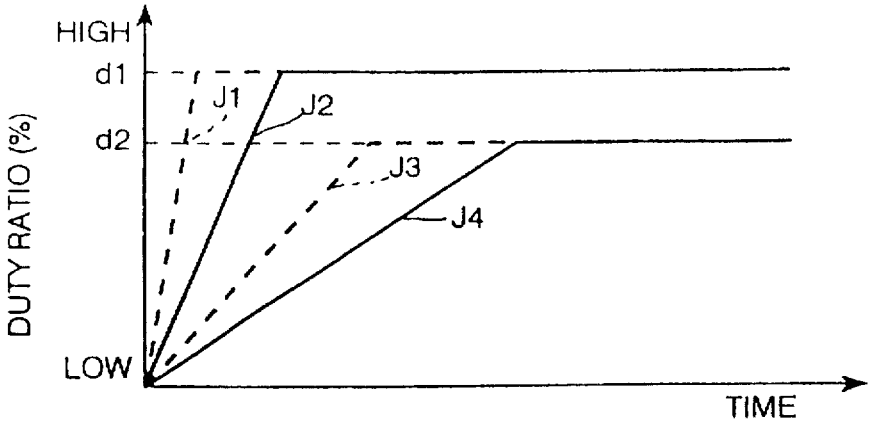
FIG. 14A
FIG. 14B
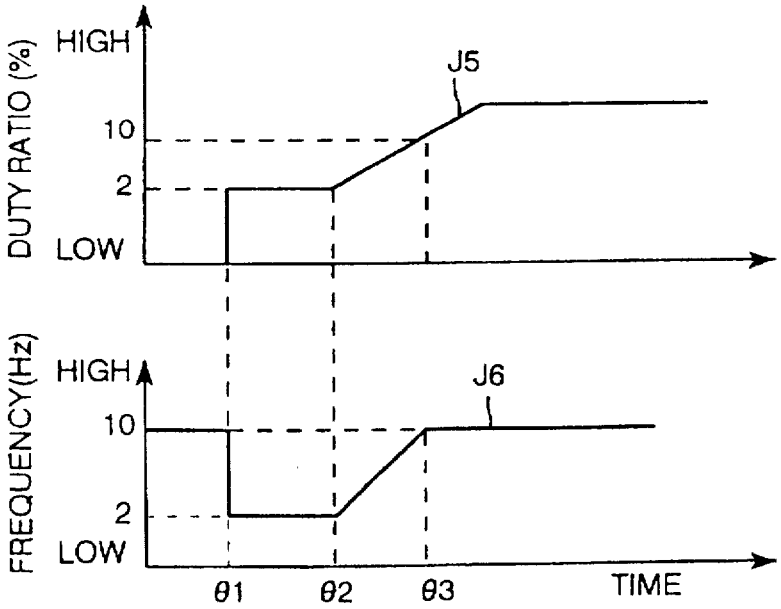

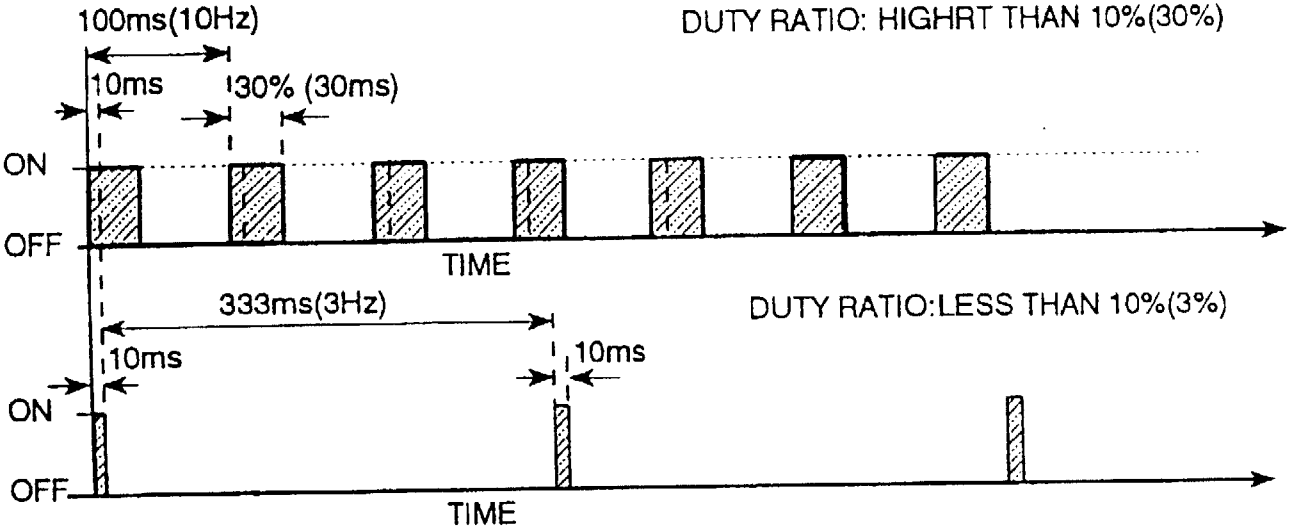
FIG. 15A SOLENOID
FIG. 15B SOLENOID

AUTOMOTIVE ENGINE CONTROL SYSTEM

BACKGROUND OF THE INVENTION

1. Field of the Invention

The present invention relates to an automotive engine control system for appropriately purging fuel vapor trapped in a canister into an intake system during execution of air-to-fuel ratio feedback control toward a target air-to-fuel ratio in a specified engine operating range.

2. Description of Related Art

Typically, a fuel injection type of automotive engines are equipped with control systems which determine the proper air-to-fuel ratio and then constantly monitor the exhaust to verify the accuracy of the mixture setting and adjust a basic amount of fuel according to the amount of intake air so as to deliver a correct air-to-fuel ratio for any given engine demand. Such an engine control system encounters the problem of being hard to deliver fuel without delay for the reasons that fuel injectors have some inherent performance constraints and that fuel injected from the injectors partly clings onto walls of an intake passage. Together, the fuel injectors experience changes in injection performance due to aging. Under these circumstances, it is hard to attain a stoichiometric air-to-fuel ratio or target air-to-fuel ratio only by delivering the basic amount of fuel according to the amount of intake air.

An injection type of fuel injection systems have oxygen ($O_2$) sensors, such as linear $O_2$ sensors and $\lambda O_2$ sensors, to detect the oxygen content of the exhaust. Such a direct fuel injection system determines the proper air-to-fuel ratio and then constantly monitor the accuracy of the mixture setting. Whenever the oxygen ($O_2$) sensor determines the oxygen content is off, the system determines a correctional value to correct itself to bring the oxygen back to proper levels in feedback control. If the feedback correctional value is remained neutral or fixed at a neutral value, the air-to-fuel ratio is controlled not in feedback control but in open-loop control.

In order to prevent air from being discharged directly into the atmosphere from a fuel tank tends which produces air pollution and causes a fuel lose, almost all vehicles are equipped with canisters and fuel vapor purge systems to trap fuel vapors in the canister and vents the canister to force out the trapped fuel vapors into an intake system. Such a fuel vapor purge system generally has a purge passage between the canister and intake system and a canister purge valve which opens the purge passage to allow the trapped fuel vapors to be forced out and enter into the intake system. If a canister purge occurs during execution of the open-loop air-to-fuel ratio control, the air-to-fuel ratio will deviate from the target air-to-fuel ratio. Accordingly, it is usual to cause a canister purge only in feedback air-to-fuel ratio control range of engine operating conditions.

In cases where fuel vapors forced out and enter into the intake system are dealt with as a disturbance of the air-to-fuel ratio feedback control, if, for instance the air-to-fuel ratio coincides with a target air-to-fuel ratio, fuel vapors entering into the intake system often enrich the mixture setting. As a result, the air-to-fuel ratio feedback control varies the feedback correctional value so as to provide a lean fuel mixture, bringing the air-to-fuel ratio toward a correct target ratio. If practically dealing with fuel vapors as a disturbance, the air-to-fuel ratio feedback control becomes unstable in operation due to a strengthened disturbance. In particular, during a transitional period such as immediately after commencement of a canister purge, it takes a long time to return to the target air-to-fuel ratio, the air-to-fuel ratio feedback control encounters unstable operation.

For these reasons, in the case where a canister purge occurs during execution of the air-to-fuel ratio feedback control, it is desirable in order to eliminate adverse influence of purged fuel vapors on the air-to-fuel ratio feedback control to establish the accurate mixture setting by subtracting the amount of purged fuel vapors from the demanded amount of fuel injection which is obtained, for instance, on the basis of the basic amount of fuel injection according to the amount of intake air and a feedback correctional value. While the amount of purged fuel vapors must be precise, nevertheless, there is no sensor practically available to direct detection of the precise amount of purged fuel vapors.

For establishing an accurate mixture setting, the amount of purged fuel vapors may be estimated as described in, for instance, Japanese Unexamined Patent Publication No. 2-245441. The engine control system described in the Japanese Unexamined Patent Publication No. 2-245441 estimates an amount of purged fuel vapors to enter into the intake system every revolution of engine on the basis of the difference of an air-to-fuel ratio feedback correctional value from its neutral value and decreases the basic amount of fuel injection by the estimated amount of purged fuel vapors.

In cases where purged fuel vapors are dealt with as a disturbance of the air-to-fuel ratio feedback control, if a canister purge is commenced in an engine operating range of small amounts of intake air such as an idling range where a small amount of fuel injection is required, the air-to-fuel ratio feedback control encounters strong influence of an enhanced disturbance, resulting in significantly unstable operation, which always leads to a decrease in fuel efficiency. In order to eliminate the enhanced disturbance, it may be thought to decrease the purged gas flow rate in the engine operating range of small amounts of intake air. However, because it is necessary to hold a large amount of fuel vapors stored in a canister in the engine operating range, the canister must have a large capacity. This cause such an issue that the engine must be of large size. If the canister has only an insufficient capacity, fuel vapors are easily discharged into the atmosphere.

Further, in cases where the amount of purged fuel vapors is estimated, if a canister purge is commenced in the engine operating range such as an idling range, and if an estimate of the amount of fuel vapors has not yet be completed, computation of the actual amount of fuel injection is inaccurate and, as a result, the air-to-fuel ratio feedback control encounters significantly unstable operation.

SUMMARY OF THE INVENTION

It is therefore an object of the invention to provide an engine control system in which, while the mixture setting is feedback controlled so as to bring the air-to-fuel ratio to target levels, fuel vapors stored in a canister are promptly forced out and enter into an intake system.

It is another object of the present invention to provide an engine control system which enables a canister to be of small size and an engine to provide an increase in fuel consumption.

The aforesaid objects of the invention are achieved by providing an engine control system including a fuel injection control means for feedback controlling an amount of fuel injection to bring an air-to-fuel ratio detected by an air-to-fuel ratio detector, such as an oxygen sensor, to a target ratio in a specified range of engine operating conditions and a canister purge control means for forcing purged gas from a canister to enter into an intake system when the engine is operating in the specified range of engine operating conditions and increasingly or decreasingly varying a purged gas flow rate at a changing rate toward a target purged gas flow rate determined according to engine operating conditions after commencement of a canister purge. The purge control means provides the changing rate smaller in an engine operating range where the amount of intake air is small than in an engine operating range where the amount of intake air is large.

With the engine control system, because, when a canister purge is executed in the range of small intake air amounts, the purged gas flow rate is gradually varied at a relatively low rate, there is no quick change in the amount of fuel vapors flowing into the intake system at the beginning of a canister purge and, as a result, the air-to-fuel feedback control is prevented from being disturbed. With the progress of the canister purge, the target purged gas flow rate is attained, fuel vapors stored in the canister are swiftly forced out and enter into the intake system. On the other hand, because, when a canister purge is executed in the range of large intake air amounts where a large amount of fuel injection is required, the purged gas flow rate is gradually varied at a high rate, fuel vapors are swiftly forced out and enter into the intake system.

According to another embodiment of the invention, an engine control system includes a fuel injection control means for feedback controlling a mixture setting to bring an air-to-fuel ratio detected by an air-to-fuel ratio detector, such as an oxygen sensor, to a target ratio in a specified range of engine operating conditions and a purge control means for increasingly or decreasingly varying a purged gas flow rate at a changing rate so as to attain a target purged gas flow rate determined according to engine operating conditions after commencement of a canister purge during idling. The purge control means provides the changing rate smaller before completion of an estimate of the amount of purged fuel vapors than after completion of an estimate of the amount of purged fuel vapors. The fuel injection control means determines a basic amount of fuel injection according to an amount of intake air, provides a correctional feedback value according to a deviation of an air-to-fuel ratio from the target ratio, determines a demanded amount of fuel injection on the basis of these basic amount of fuel injection and correctional feedback value, estimates an amount of purged fuel vapors from the canister on the basis of the correctional feedback value, and feedback controlling a fuel mixture setting according to a difference between the demanded amount of fuel and the estimated amount of purged fuel vapors so as to bring the air-to-fuel ratio to the target ratio in the specified range of engine operating conditions.

With the engine control system, while the feedback control is stably performed during execution of a canister purge and provides reliable responsiveness, the amount of purged fuel vapors is increased due to an increase in the purged gas flow rate. Because the feedback control is made on the basis of an amount of fuel injection obtained by subtracting the amount of purged fuel vapor from the amount of fuel according to engine demand, more improved stability and responsiveness in operation of the feedback control is assured. Together, because the purged gas flow rate is gradually increased at a relatively low changing rate before completion of an estimate of the amount of fuel vapor when a canister purge is executed in an idle range where a small amount of fuel injection is required, the air-to-fuel ratio feedback control is prevented from being disturbed at the beginning of the canister purge even when the amount of fuel vapor stored in the canister, or the amount of purged fuel vapors, is precisely detected.

The purge control means gradually increases the purged gas flow rate at said changing rate to bring the purged gas flow rate toward said target rate.

When a canister purge is executed during off-idling in the specified range of engine operating conditions, the purge control means may varies a purged gas flow rate at an increasing rate so as to attain a target purged gas flow rate determined according to engine operating conditions and changes the increasing rate smaller after completion of an estimate of the amount of purged fuel vapors during idling than before completion of an estimate of the amount of purged fuel vapors during off-idling.

The amount of purged fuel vapors may be estimated on the basis of an average correctional feedback value with an effect of facility and updated in learning control with an effect of improving the accuracy of estimate of the amount of purged fuel vapors.

The purge control means includes a canister purge valve activated to turn on and off at a duty ratio according to a purged gas flow rate. The period of time for which the canister purge valve remains turned on is fixed and the frequency of activation of the canister purge valve is varied according to a duty ratio when the duty ratio is less than a specified rate. In this case, the purged gas flow rate is accurately controlled by a size of opening of the purge valve which is precisely adjustable. Further, for duty ratios less than the specified rate, the number of times of opening and closing the purge valve is reduced.

BRIEF DESCRIPTION OF THE DRAWINGS

The above and other objects and features of the present invention will be clearly understood from the following description with respect to a preferred embodiment thereof when considered in conjunction with the accompanying drawings, in which:

FIG. 11 is a graphical diagram showing a relation between average correctional feedback value and the trapped amount of fuel vapor;

FIG. 12 is a time chart showing changes in various variable factors with respect to time;

FIG. 13 is a time chart showing changes in duty ratio with respect to time;

FIG. 14 is a time chart showing a change in operation frequency of the purge valve according to a change in duty ratio; and FIG. 15 is a diagram showing a relation between duty ratio and frequency of the purge valve.

DETAILED DESCRIPTION OF THE PREFERRED EMBODIMENTS

Figure 1:
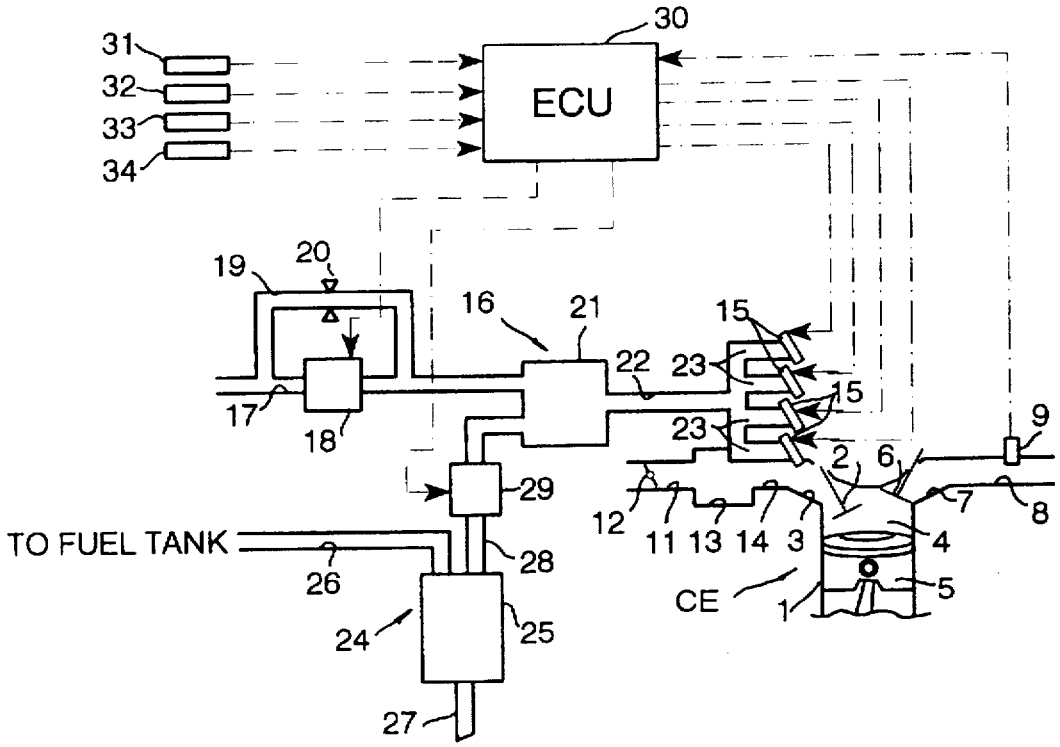
FIG. 1 is a schematic illustration of an engine equipped with a control system according to an embodiment of the invention.

Referring to the drawings in detail, in particular, to FIG. 1 schematically showing a fuel injection type of gasoline engine CE incorporating an engine control system in accordance with a specific embodiment of the invention, the engine CE is of a type having, for instance, four cylinders 1 (only one of which is shown) in each of which a piston 5 slides up and down. Each cylinder 1 is formed with a combustion chamber 4 into which an air-fuel mixture is delivered through an intake port 3 when an intake valve 2 is opened and from which burned gas or exhaust gas is discharged into an exhaust manifold or exhaust pipe 8 through an exhaust port 7 when an exhaust valve 6 is opened. The engine control system includes an oxygen sensor ($O_2$ sensor) 9, such as a linear oxygen sensor (linear $O_2$ sensor) and a lambda oxygen sensor ($\lambda O_2$ sensor), disposed in the exhaust pipe 8 to constantly monitor the exhaust gas to verify the accuracy of the mixture setting. Whenever the oxygen sensor ($O_2$ sensor) 9 determines the oxygen content is off, an electronic control unit (ECU) 30 of the engine control system corrects the fuel system to bring the oxygen back to proper levels and tries to maintain a stoichiometric air-fuel mixture, i.e. an ideally combustible air-to-fuel ratio. As is well known in the art, the linear $O_2$ sensor can detect the oxygen content of exhaust gas even in a range where the excess air factor $\lambda$ is greater than 1 (one), and the lambda oxygen sensor ($\lambda O_2$ sensor), however, detects only whether the excess air factor $\lambda$ is greater than 1 (one) or not. An intake system 10 of the engine CE includes an intake pipe 11 open to the atmosphere at its upstream end and an intake manifold 14 connecting the intake pipe 11 to the intake ports 3 of the cylinders 1 individually. The intake pipe 11 is formed with a surge tank 13 at the juncture with the intake manifold 14 which stabilizes the flow of intake air and provided with a throttle valve 12 linked to an accelerator pedal (not shown). The engine CE has a fuel injector 15 located in the intake manifold 14 in proximity to the intake port 3 of each cylinder 1. The fuel injector 15 is positioned to inject and direct fuel toward the intake port 3 and is activated continuously or intermittently to deliver fuel of the amount depending upon an injection pulse width which is controlled by the control unit (ECU) 30.

As is simply shown in FIG. 1, in order for the fuel injection system to promote fuel atomization and vaporization, an assist air delivery system (AMI) 16 is provided. This assist air control system 16 includes a mixing chamber 21 to which an assist air induction pipe 17 and an assist air delivery pipe 22 are connected. Although not shown in FIG. 1, the assist air induction pipe 17 at its upstream end is in communication with the intake pipe 11 at a point upstream from the throttle valve 12. The assist air induction pipe 17 is provided with a solenoid type of air check valve 18 to control the amount of air flowing through the assist air induction pipe 17 and a bypass pipe 19 which allows air to flow bypassing the air check valve 18. The amount of air flowing through the bypass pipe 19 is regulated by an orifice 20. The assist air delivery pipe 22 is connected to the fuel injectors 15 by means of a manifold 23 to deliver assist air to the fuel injectors 15, respectively.

The engine CE is provided with a vapor trapping system 24 which prevents gasoline vapors from escaping into atmosphere from a fuel tank (not shown) and is composed basically of a vapor storage canister 25 and a purge pipe 28 which connects the interior of vapor storage canister 25 to the mixing chamber 21 and is provided with a purge valve 29. The canister 25 contains a bed of highly activated charcoal (carbon) particles. While the engine CE is turned off, fuel vapors from the fuel tank enter the canister 25 through a fuel tank vent tube 26. When the fuel vapors touch the charcoal, the charcoal particles absorb and store the fuel vapors. On the other hand, upon starting the engine CE, vacuum is formed and draws fresh air through the charcoal bed via a pipe 27 open to atmosphere. As the purge air passes over the charcoal, it picks up the stored fuel vapors and draws them into the mixing chamber 21 where they will be mixed with intake air. The pipe 27 may be connected to the intake pipe 11 upstream from the throttle valve 12 so as to draw the intake air through the canister. In place of the charcoal particles, materials which can absorb and react on fuel vapors and release them with purge air.

The duty solenoid type of purge valve 29 is duty controlled to open and close the purge pipe 28, linearly controlling the flow rate of purged gas consisting air and fuel vapors. If the duty cycle of the purge valve 29 is 100 milliseconds, the purge valve 29 varies an interval for which it remains completely open according to duty ratios. For example, at a duty ratio of 30%, the purge valve 29 continuously opens 30 milliseconds and continuously closes 70 milliseconds subsequently to opening every cycle. Accordingly, the purge valve 29 completely closes at a duty ratio of 0% and completely opens at a duty ratio of 100%. Hereafter, the interval for which the purge valve 29 remains open will be referred to as the ON interval, and the interval for which the purge valve 29 remains closed will be referred to as the OFF interval.

While the duty solenoid type of purge valve 29 enables to increasingly or decreasingly vary the purged gas flow rate proportionally to duty ratios, because it is possibly hard to precisely control the purge valve 29 if the ON interval is too short, for instance shorter than 10 milliseconds, an operational constraint must be imposed on the purge valve 29. That is, the purge valve 29 must always remain open at least 10 milliseconds. In order to fulfill this constraint, the purge valve 29 is designed and adapted such that, when duty ratios are greater than 10%, it operates on a fixed frequency of, for instance, 10 Hz (a cycle of 100 milliseconds) so as to open variably and proportionally in interval to the duty ratios and, when duty ratios are less than 10%, it operates, however, on a variable frequency altered or extended proportionally to the duty ratios so as to always open for a fixed interval of, for instance, 10 milliseconds.

Specifically describing by way of example, as shown in FIG. 15, in the event where the duty solenoid valve 29 is activated at a duty ratio of 30% or 0.3 which is greater than the critical duty ratio 10%, the duty solenoid valve 29 is operated on a fixed frequency of 10 Hz (a operational cycle of 100 milliseconds), so as to open for an ON interval of 30 milliseconds. The proportion of ON interval in relation to one cycle is 0.3 and is accordingly proportional to the duty ratio. However, in the event where the duty solenoid valve 29 is activated at a duty ratio of 3% or 0.03 which is less than the critical duty ratio 10%, the duty solenoid valve 29 is operated on a frequency of approximately 3 Hz (a operational cycle of 333 milliseconds) which is proportional to and, as a result, remains open for a fixed ON interval of 10 milliseconds. In this event, the proportion of ON interval in relation to one cycle is 0.03 and is accordingly proportional to the duty ratio. In this manner, the purge valve 29 can precisely control the purged gas flow rate according to duty ratios even if being operated at the duty ratios less than 10%.

While the purge valve 29 remains closed, air from the fuel tank enters into the vapor storage canister 25 through the fuel tank vent tube 26, moves down through the charcoal and escapes into atmosphere through the pipe 27. While the air moves down through the charcoal, fuel vapors are absorbed by the charcoal particles and stored in the canister 25.

While the purge valve 29 remains open, vacuum formed in the intake pipe 11 draws fresh air through the charcoal bed via the pipe 27 and, as the purge air passes over the charcoal, it picks up the stored fuel vapors and draws them into the mixing chamber 21 through the purge pipe 28 and the assist air control system 16 (between the mixing chamber 21 and the manifold 23), and then into the combustion chamber 4. The purge air flow rate, and hence the purged fuel vapor flow rate, depends upon the degree of opening of the purge valve 29 which is proportional to the duty ratio.

Because the passage through which purged gas containing fuel vapors pass has quite a large volume, the purged gas drawn into the purge pipe 28, which contains fuel vapors, encounters a time delay in air and fuel vapor conveyance depending the volume and configuration of the passage before arrival at the combustion chamber 4. Accordingly, at a certain time, the drawn rate at which fuel vapors are drawn into the purge pipe 28 from the canister 25 and the inflow rate at which the fuel vapors flow into the combustion chamber 4 do not usually agree with each other excepting particular cases where the purged air and fuel vapors (purged gas) flow in a steady state. For this reason, the purged fuel vapor flow rate or amount of fuel vapors will be hereafter referred separately to as the fuel vapor drawn rate or the fuel vapor inflow rate. On the other hand, because, in cases where the passage between the canister 25 and the combustion chamber 4 has quite a small volume, the time delay in air and fuel conveyance can be ignored, the fuel vapor drawn rate and the fuel vapor inflow rate may be regarded as the same.

Figure 2:
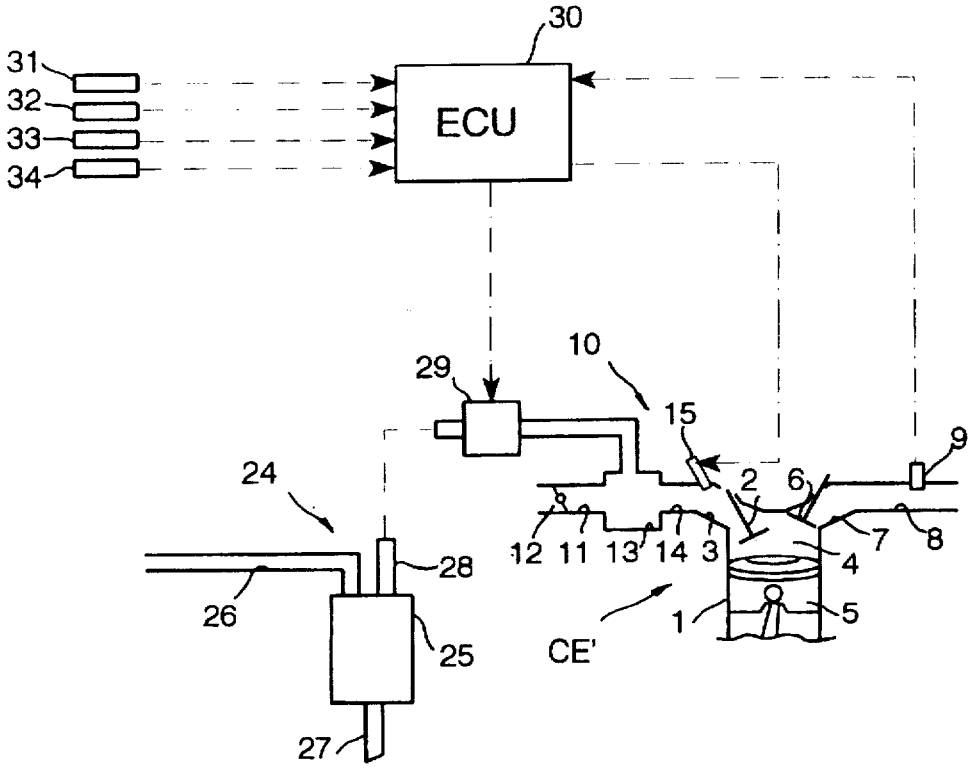
FIG. 2 is a schematic illustration of an engine equipped with a control system according to another embodiment of the invention.

Although the engine CE shown in FIG. 1 is provided with the assist air control system 16 including the mixing chamber 21, and fuel vapors are drawn into the intake system 10 from the canister 25 through the assist air control system 16, in cases where an engine CE' is not provided wit an assist air control system as shown in FIG. 2, the purge pipe 28 may be connected directly to the intake system 10, for instance to the surge tank 13 of the intake system 10.

Electronic control unit 30, which is mainly consisted of a microcomputer, govern overall operation of the engine CE or CE' including the vapor trapping system 24 on the basis of control information provided by various sensors. The sensors include, in addition to the oxygen ($O_2$) sensor 9 which monitors the content of oxygen in the exhaust gas as an air-to-fuel ratio, a throttle sensor 31 which monitors opening of the throttle valve 12, an air flow sensor 32 which monitors the amount of air introduced into the intake system 10, a speed sensor 33 which monitors the rotational speed of engine, an idle switch 34 which monitors that the engine CE or CE' runs idle. All these sensors 9, 31-33 and switch 34 are well known in various forms in the art and may take any well known types. The control unit 30 estimates the amount of fuel vapors stored or trapped in the canister 25 and computes both drawn rate and inflow rate of fuel vapors in order to govern the overall operation of the engine CE or CE'.

Figure 3:
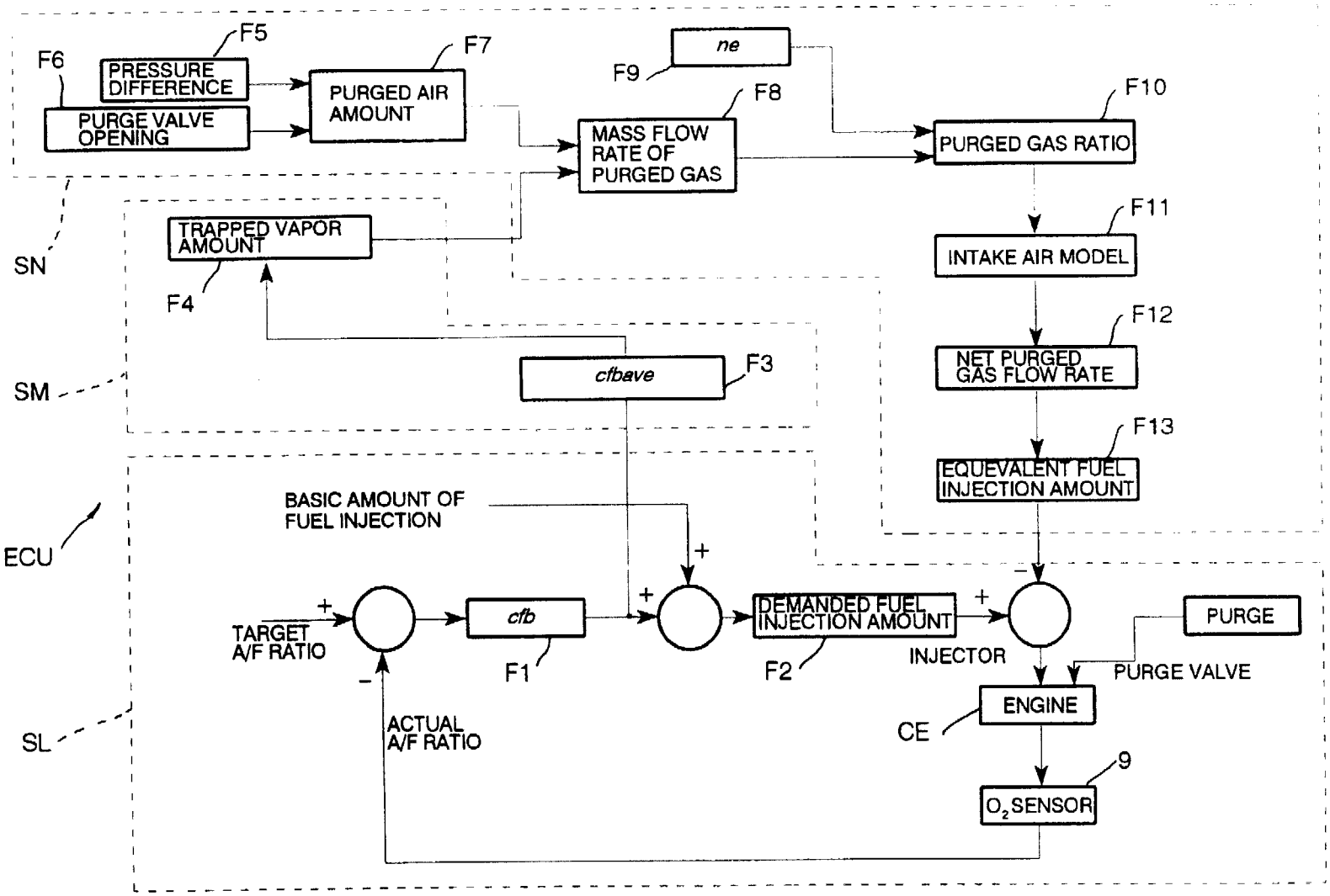
FIG. 3 is a functional block diagram showing an electronic control unit used in the control system of FIG. 1 or 2.

FIG. 3 shows a block diagram illustrating fundamental functions of the electronic engine control unit (ECU) 30. As shown in FIG. 3, the control unit 30 is divided broadly into three control sections, namely an engine control section SL where fuel injection control and canister purge control are governed, an estimating section SM where the trapped amount of fuel vapors is estimated, and a computing section SN where both drawn rate and inflow rate of fuel vapors are computed.

Engine control section SL constantly monitors engine operating conditions, such as engine speed, engine load, throttle position, etc., and, based on all these incoming signals, adjust pulse width so as to deliver a corrected or target air-to-fuel ratio for any given engine demand in closed or feedback control or in open loop control. Together, the engine control section SL performs the canister purge control according to engine operating conditions which necessitate a canister purge. The air-to-fuel feedback control is executed to bring an actual air-to-fuel ratio to a target air-to-fuel ratio or to eliminate a deviation between these actual air-to-fuel ratio and target air-to-fuel ratio when the engine is operating in a specified range of engine operating conditions excluding high engine load and high engine speed conditions. On the other hand, when the engine is operating under conditions out of the specified range, the air-to-fuel open loop control is executed.

In the feedback control, while a basic fuel injection pulse width, i.e. a basic amount of fuel injection, depending upon which the amount of fuel to be delivered by the injector 15, is computed on the basis of an engine speed and the amount of intake air, an air-to-fuel ratio deviation between a target air-to-fuel ratio and an actual air-to-fuel ratio which is monitored by the oxygen ($O_2$) sensor 9. At function block F1, a correctional pulse width, namely a correctional amount of fuel injection (which is referred to as a correctional value for simplicity) cfb by which the engine demand fuel injection pulse width (i.e. the demanded amount of fuel) is corrected in the feedback control is computed on the basis of the air-to-fuel ratio deviation. In this instance, the feedback control causes a decreasing change in air-to-fuel ratio to enrich the mixture setting if the correctional value cfb takes plus values, or causes an increasing change in air-to-fuel ratio to make the mixture setting more leaner if the correctional value cfb is minus (cfb<0). However, if the correctional value cfb has a neutral value of 0 (zero), the air-to-fuel ratio is held unchanged.

The basic fuel injection pulse width (i.e. the basic amount of fuel injection) is corrected by, for instance, being added by the correctional value cfb so as to decrease the deviation of the actual air-to-fuel ratio from the target air-to-fuel ratio. In this manner, an demanded fuel injection pulse width, i.e. the amount of fuel to be delivered according to an engine demand is computed at function block F2. For instance, if the actual air-to-fuel ratio is on a side leaner than the target air-to-fuel ratio, the correctional value cfb takes a plus value and, according to the correctional value cfb, the air-fuel mixture is enriched in the feedback control, with the result of a gradual reduction in the deviation of the actual air-to-fuel ratio. Conversely, if the actual air-to-fuel ratio is on a side richer than the target air-to-fuel ratio, the correctional value cfb takes a minus value. As the air-fuel mixture is altered more leaner according to the correctional value cfb in the feedback control, the air-to-fuel ratio deviation is also gradually reduced.

In cases where the open loop control is executed, the correctional value cfb is fixed at 0 (zero) and, consequently, the basic fuel injection pulse width is directly used as a demanded fuel injection pulse width.

Subsequently, an eventual fuel injection pulse width (i.e. the eventual amount of fuel injection) is computed by subtracting a correctional value corresponding to the fuel vapor inflow rate from the demanded fuel injection pulse width. The fuel injector 15 is timely activated to deliver fuel of the amount depending upon the eventual fuel injection pulse width.

Canister purge control is executed according to engine operating conditions in a manner well known in the art when canister purge conditions are satisfied. The canister purge conditions may be satisfied by, for instance, the temperature of engine cooling water higher than, for instance, approximately 80° C. In the canister purge control, the purge valve 29 is activated at a duty ratio according to engine operating conditions to draw fuel vapors into the intake system 10 from the canister 25.

Estimating section SM computes an average correctional value cfbave by averaging correctional values cfb during execution of the canister purge control at function block F3 and estimates indirectly an amount of trapped vapors trap on the basis of the average correctional value cfbave at function block F4. In other words, the average correctional value cfbave is used as a reference value for determining as to whether the estimated amount of trapped vapors trap is greater or less than the actual amount of trapped vapors trap.

As will be described later, the control unit 30 computes the inflow fuel vapor amount by use of a specific formula which includes the estimated amount of trapped vapors trap as an element and further computes the eventual amount of fuel by subtracting the inflow fuel vapor amount from the demanded amount of fuel. In this instance, because, if the estimated amount of trapped vapors trap is accurate, or agrees with the actual amount of trapped vapors trap, the inflow fuel vapor amount is accurately computed, fuel vapors delivered into the combustion chamber 4 do not become a disturbance of the feedback control nor exerts an adverse influence on the correctional value cfb. If the feedback control does not encounter significant disturbances, the correctional value cfb experiments only small fluctuations on both sides of the neutral correctional value (0), and the average correctional value cfbave becomes almost zero, consequently. In other words, if the average correctional value cfbave is 0 (zero), the estimated amount of trapped vapors trap agrees with the actual amount of trapped vapors trap. On the other hand, if the amount of trapped vapors trap is estimated to be greater than the actual amount of trapped vapors trap, the inflow fuel vapor amount has a deviation from the actual amount of trapped vapors trap. This leads to delivery of an inappropriate amount of fuel into the combustion chamber 4 which is less than the demanded amount of fuel and provides a tendency of attenuation of air-to-fuel ratio. In this event, in order to rectify the attenuation of air-to-fuel ratio, the correctional value cfb is altered to become greater than 0 (zero) with the result of altering the average correctional value cfbave to become also greater than 0 (zero). In other words, if the average correctional value cfbave is greater than 0 (zero), the estimated amount of trapped vapors trap is greater than the actual amount of trapped vapors trap.

However, because of fluctuations of the average correctional value cfbave, the correctional value cfb does not always become greater than 0 (zero) even if the estimated amount of trapped vapors trap is greater than the actual amount of trapped vapors trap. In other words, the estimated amount of trapped vapors trap is not always greater than the actual amount of trapped vapors trap even if the correctional value cfb is greater than 0 (zero). It is conceivable that the estimate of the amount of trapped vapors trap on the basis of correctional values cfb is not always precise. In these circumstances, the average correctional value cfbave is employed in this embodiment to make a precise estimate of the amount of trapped vapors trap. Conversely, if the estimated amount of trapped vapors trap is less than the actual amount of trapped vapors trap, the computed inflow fuel vapor amount becomes less than an actual amount, and hence, since the actual amount of fuel injected from the given fuel injector 15 becomes greater than an appropriate amount, the amount of fuel actually delivered into the combustion chamber 4 becomes greater than the demanded amount of fuel and provides a tendency of enrichment of air-to-fuel ratio. In this event, in order to rectify the enrichment of air-to-fuel ratio, the correctional value cfb is altered to become less than 0 (zero) with the result of altering the average correctional value cfbave to become less than 0 (zero). In other words, if the average correctional value cfbave is less than 0 (zero), the estimated amount of trapped vapors trap is less than the actual amount of trapped vapors trap.

Accordingly, the estimated amount of trapped vapors trap reaches the actual amount of trapped vapors trap by repeatedly decreasing an appropriate initial amount of trapped vapors by a specified correctional amount $\sigma$ if the average correctional value cfbave is greater than 0 (zero) or by repeatedly increasing the appropriate initial amount of trapped vapors by the specified correctional amount $\sigma$ if the average correctional value cfbave is less than 0 (zero). In this event, it is desirable to judge agreement of the estimated amount of trapped vapors trap with the actual amount of trapped vapors trap, I.e. the conclusion of an estimate of the amount of trapped vapors trap, on the basis whether the absolute value of average correctional value (|cfbave|) is less than a specified reference value $\epsilon$. This is because if the absolute value of average correctional value (|cfbave|) is considerably less than the reference value $\epsilon$, it is conceived that the estimated amount of trapped vapors trap approximately agrees with the actual amount of trapped vapors trap.

Because this estimate of the amount of trapped vapors trap is enabled on the condition that the above mentioned specific correlation is satisfied between the amount of trapped vapors trap or the amount of fuel vapor purge and correctional value cfb or average correctional value cfbave, if the specific correlation is poor or there is no specific correlation between them, a precise estimate of the amount of trapped vapors trap is impossible, and it is preferred to prohibit the estimate of the amount of trapped vapors trap. Conditions where the specific correlation is poor between them take place, for instance, when an air charging efficiency and/or the pressure of intake air are significantly high or significantly low. Further, conditions where the specific correlation does not exist between them occur, for instance, when a canister purge is prohibited or when the air-to-fuel ratio feedback control is interrupted (i.e. the air-to-fuel ratio is under the open-loop control). It may be of course preferred to prohibit the estimate of the amount of trapped vapors trap only when some of these conditions occur together. In addition, this estimate of the amount of trapped vapors trap is enabled on the condition that the average correctional value cfbave fluctuates on both sides of the neutral correctional value of 0 (zero) and converges the neutral correctional value of 0 (zero) consequently, as long as the inflow fuel vapor amount is precisely computed, i.e. unless fuel vapors purged from the canister affect the average correctional value cfbave.

For engines equipped with fuel injection systems which control engine output in air-to-fuel ratio learning control where the fuel injection characteristics are automatically corrected, it is preferred to perform the estimate of the amount of trapped vapors trap after completion of the air-to-fuel ratio learning control. This is because, if the air-to-fuel ratio learning control has been completed, the average correctional value cfbave certainly converges the neutral correctional value of 0 (zero) unless fuel vapors purged from the canister affect the average correctional value cfbave. When the estimate of the amount of trapped vapors is continuously interrupted for a specified period of time, there occur apprehensions that the estimated amount of trapped vapors is different from the actual amount of trapped vapors. In such an event, the judgement of completion of the estimate of the amount of trapped vapors is preferably canceled.

If the specified correctional amount $\sigma$ is large, the estimate of the amount of trapped vapors is concluded in a short time and, however, not always precise. On the other hand, if the specified correctional amount $\sigma$ is small, the estimate of the amount of trapped vapors is precise and a time necessary to conclude the estimate of the amount of trapped vapors is, however, prolonged. Accordingly, it is imperative that the correctional amount $\sigma$ must be established appropriately according to demands for both high estimating accuracy and short estimating time. The correctional amount $\sigma$ is not always necessary to remain constant and may be variable during execution of an estimate of the amount of trapped vapors. For instance, the correctional amount $\sigma$ may be varied according to progress of an estimate of the amount of trapped vapors or in conformity with the average correctional value cfbave. Practically, the correctional amount $\sigma$ is made large at the beginning of an estimate of the amount of trapped vapors to make the estimated amount of trapped vapors converge rapidly and then varied smaller after conversion of the estimated amount of trapped vapors to some extent so as to increase the estimating accuracy. If the correctional amount $\sigma$ is made larger with an increase in the average correctional value cfbave, the estimated amount of trapped vapors converges rapidly when it is greatly different from the actual amount of trapped vapors and, on the other hand, the estimated amount of trapped vapors is more precise when it is close to the actual amount of trapped vapors.

Computing section SN computes the drawn rate of fuel vapors on the basis of the amount of trapped vapors estimated at function block F4 in the estimating section SM and further computes the inflow rate of fuel vapors on the basis of the drawn rate of fuel vapors. A correctional value in conformity with the inflow rate of fuel vapors is computed and transferred to the engine control section SL. In other words, an effect of fuel vapors to an air-to-fuel ratio is compensated in feed-forward control without being accompanied by a time lag or deviation of the air-to-fuel ratio. Specifically, a pressure difference in the purge pipe 28 between points before and after the purge valve 29 (which is hereafter referred to as a purge valve pressure difference) is computed at function block F5, and purge valve opening is computed on the basis of a duty ratio at which the purge valve 29 is activated at function block F6. Subsequently, the amount of air drawn or purged from the canister (purged air) is computed based on both purge valve pressure difference and purge valve opening at function block F7. In this instance, the purge valve pressure difference is computed on the basis of air charging efficiency ce for the reasons described below.

Air pressure at a point immediately after the purge valve 29 is regarded to be approximately equal to intake air pressure which can be computed based on air charging efficiency ce in a well known manner. On the other hand, air pressure at a point immediately before the purge valve 29 is regarded to be substantially fixed or equal to the pressure of the atmosphere. Accordingly, the purge valve pressure difference is the difference between the intake air pressure and the pressure of atmosphere and computed by use of a specific formula including air charging efficiency ce as a parameter. This manner of computation of the purge valve pressure difference eliminates an intake air pressure sensor in the intake system 10 and enables the intake system 10 to be simple in structure consequently. It may be of course permitted to install an intake air pressure sensor which detects intake air pressure at a point immediately after the purge valve or a pressure sensor which detects directly the difference in pressure between points before and after the purge valve 29.

In a well known manner for computing the amount of purged air may be computed based on both purge valve pressure difference and purge valve opening, the utilization is made of the following general principle. As is well known in the field of hydromechanics, there exists specific correlation between the pressure difference of gas $\Delta P$ between points before and after a device installed in an airtight gas passage, i.e. a pressure lose, and the flow rate of gas u passing through the device, which is generally given by the following formula.

$$\Delta P = k \cdot u^2$$

From the formula, the flow rate of gas passing through a device is computed on the basis of the gas pressure difference between points before and after the device. The volume of gas flowing through the gas passage is computed by multiplying the flow rate of gas by the cross-sectional area of the device. Accordingly, by the use of the general principle in this instance, the amount of purged air is computed on the basis of the pressure difference between points before and after the purge valve 29 and the purge valve opening from which the cross-sectional area of the purge valve 29 is easily obtained. Alternatively, the amount of purged air may be directly measured by use of a air-flow sensor well known in the art.

On the basis of the amount of purged air and the estimated amount of trapped vapors, the drawn rate of fuel vapors (mass flow rate of fuel vapors) is computed at function block F8. Thereafter, at function block F10, a purged gas ratio, which indicates a proportion or a contributory rate of fuel vapors drawn into the purge pipe 28 relative to the demanded amount of fuel, is computed on the basis of the drawn rate of fuel vapors and an engine speed detected at function block F9. After establishing a flow model (a model of delay in air and vapor conveyance) for an air and fuel vapor passage from the canister 25 to the combustion chamber 4 at function block F11, a net purged gas ratio is computed on the basis of the purged gas ratio and the flow model at function block F12. This net purged gas ratio indicates an inflow rate of fuel vapors flowing into the combustion chamber 4 relative to the demanded amount of fuel. As apparent, the amount of fuel to be eventually injected from the given injector 15 is computed by multiplying the demanded amount of fuel by the fuel rate difference (1–net purged gas ratio). A correctional value in conformity with the net purged gas ratio is computed at function block F13 and transferred to the engine control section SL.

The operation of the electronic control unit (ECU) 30 depicted in FIG. 1 or 2 is best understood by reviewing FIGS. 4 through 12, which are flowcharts illustrating various sequential routines of engine operation control.

Figure 4:
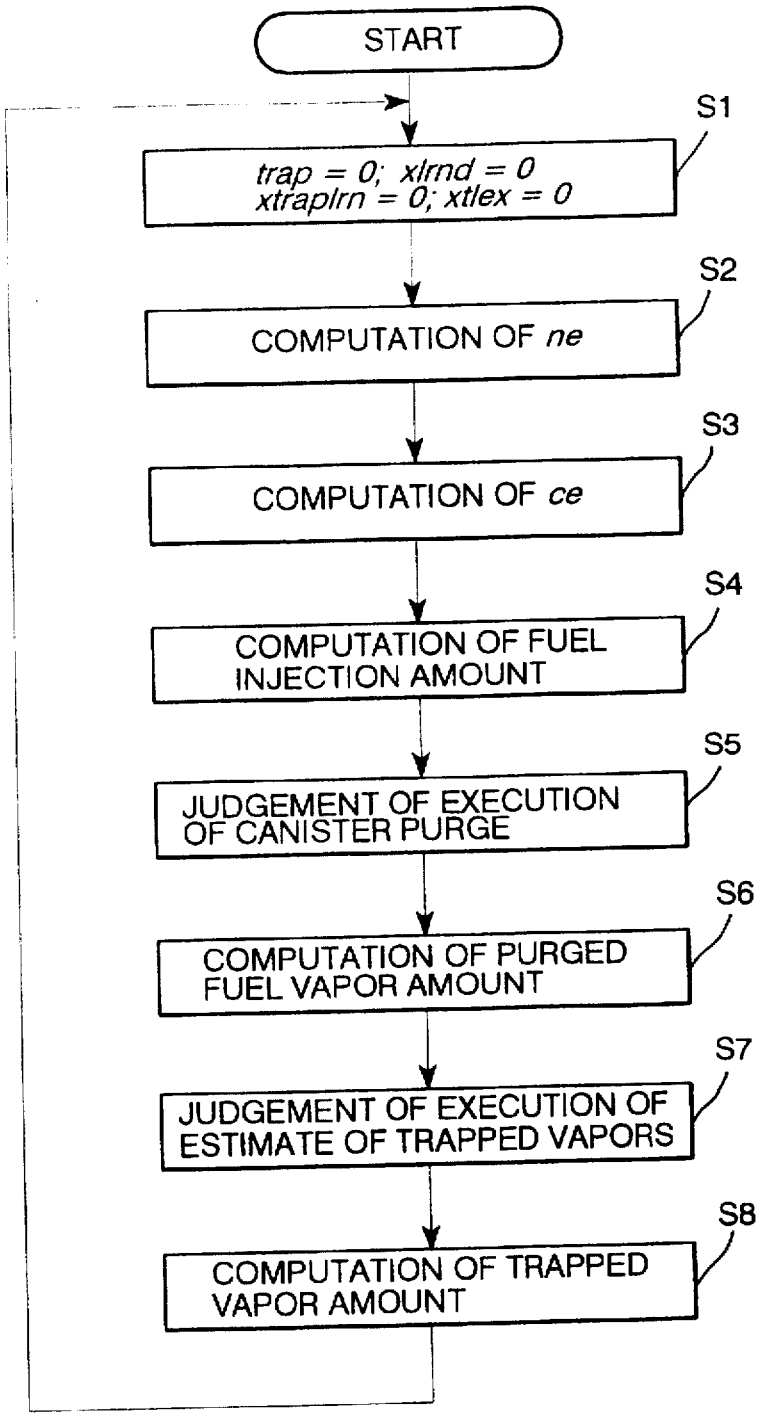
FIG. 4 is a flowchart illustrating an engine control maine routine for the electronic control unit.

Referring to FIG. 4, which is a flowchart illustrating the engine operation control main routine, the flowchart logic commences and control passes directly to function block at S1 where the control unit (ECU) 30 is initialized. Specifically, the initialization is completed by resetting the estimated amount of trapped vapors trap to 0 (zero), and setting down or resetting various decision flags, such as a learning completion flag xlrnd, an estimate completion flag xtraplrn and an estimate condition flag xtlex, to initials values or states. In this instance, the learning completion flag xlrnd is up or set to 1 (one) when learning of the air-to-fuel ratio is completed, the estimate completion flag xtraplrn is up or set to 1 (one) when an estimate of the amount of trapped vapors is completed and down or reset to 0 (zero) while an estimate of the amount of trapped vapors is continuously interrupted for a period longer than a specified time, and the estimate condition flag xtlex is up or set to 1 (one) when estimating conditions are satisfied and down or reset to 0 (zero) when the estimating conditions are unsatisfied.

Subsequently, the rotational speed ne of engine is computed at step S2, and the air charging efficiency ce is computed on the basis of various engine operating conditions including at least the amount of intake air, the engine speed ne and the temperature of intake air in a well known manner. Thereafter, various subroutines are subsequently called for to estimate the amount of trapped vapors at steps S4 through S8.

Figure 5:
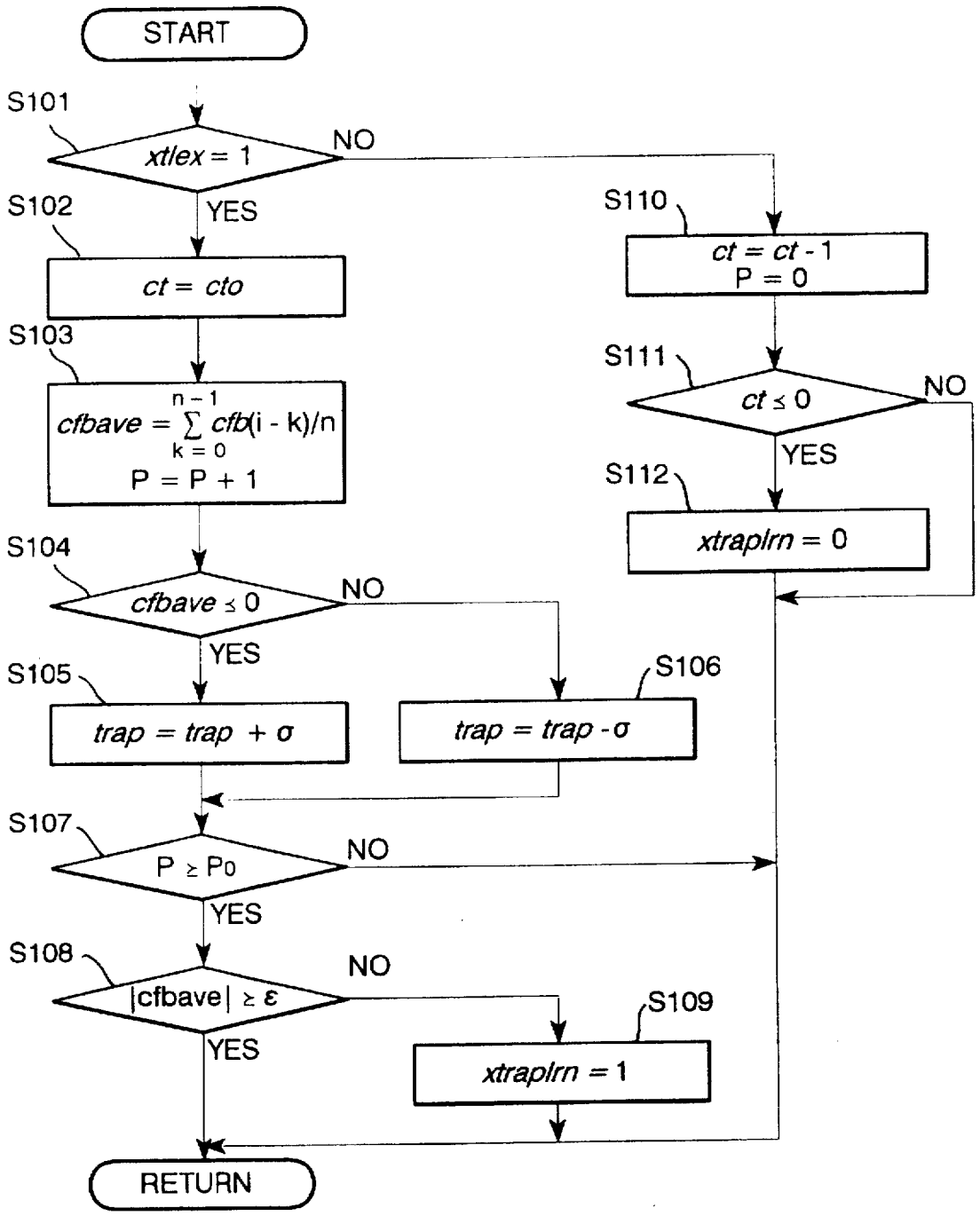
FIG. 5 is a flowchart illustrating a trapped vapor amount computing subroutine.

FIG. 5 is a flowchart illustrating the subroutine of estimating the amount of trapped vapors called for at step S8 of the main routine illustrated in FIG. 4. The flowchart logic commences and control passes directly to function block at S101 where a determination is made as to whether an estimate condition flag xtlex has been up or set to "1" which indicates that an engine operating condition meets all of requirements for a precise estimate of the amount of trapped vapors. In this instance, the following requirements are specified to permit a precise estimate of the amount of trapped vapors:

(1) Canister purge occurs;

(2) The air-to-fuel ratio feedback control is being performed;

(3) The air charging efficiency ce is less than a specified rate; and (4) The learning control of air-to-fuel ratio has been completed. In order to prohibit an estimate of the amount of trapped vapors when the pressure of intake air is lower than a specified pressure level, it may be added as a requirement for the precise estimate of the amount of trapped vapors that the air charging efficiency ce, based on which the pressure of intake air can be computed, is between a lower limit and an upper limit which is represented by the specified rate.

When an engine operating condition does not meet at least any one of the requirements (1) through (4), an estimate of the amount of trapped vapors is interrupted from the following reasons.

As was previously mentioned above, because, if at least either one of the requirements (1) and (2) is not satisfied, the specific correlation does not exist between the amount of trapped vapors and the correctional value cfb or the average correctional value cfbave and the estimate of the amount of trapped vapors is inaccurate or impossible, an estimate of the amount of trapped vapors is prohibited. Further, because, if the air charging efficiency ce or the pressure of intake air is considerably high, the purge valve pressure difference becomes considerably low and intake air experiences strong fluctuations which cause a change in the correctional value cfb and disable a precise estimate of the amount of trapped vapors, an estimate of the amount of trapped vapors is prohibited. On the other hand, because, if the air charging efficiency ce or the pressure of intake air is considerably low, the purge valve pressure difference becomes too high, resulting in an inaccurate estimate of the amount of trapped vapors, an estimate of the amount of trapped vapors is also prohibited. The reason why an estimate of the amount of trapped vapors is performed after completion of the learning control of air-to-fuel ratio is on the ground that an estimate of the amount of trapped vapors is performed with a high precision in particular after completion of the learning control of air-to-fuel ratio.

When the answer to the determination made at step S101 is "YES," this indicates that an engine operating condition meets all of the requirements, then, a time counter changes its count ct to an initial value $ct_0$ at step S102. The time counter counts a time for which an estimate of the amount of trapped vapors is interrupted due to an unsatisfactory engine operating condition against the requirements for precise estimate. Subsequently, at step S103, an average correctional value cfbave is computed from the following formula (I), and a computation counter changes its count P by an increment of 1 (one) to count the number of computation.

$$cfbave=\Sigma(k=1\rightarrow n-1)[cfb(i-k)]n \quad \text{(I)}$$

where cfbave is the average correctional value;

cfb(i) is the correctional value at the current estimate;

cfb(i-k) is the correctional value at the estimate k-times before; and n is the sampled number of the correctional values cfb.

In the formula (I), $\Sigma(k=\alpha\rightarrow\ominus)[f(k)]$ means the sigma computation of a function f(k) from α to β. As apparent from the above formula (I), when an engine is provided with a linear oxygen ($O_2$) sensor, the average correctional value cfbave is a geometric mean value of correctional values cfb sampled for a regular interval.

Thereafter, a determination is made at step S104 as to whether the average correctional value cfbave is equal to or less than 0 (zero). According to the result of the defemination, the the amount of trapped fuel vapors trap is increasingly or decreasingly altered. That is, the amount of trapped fuel vapors trap is increased by the correctional amount σ at step S105 if the answer to the determination is "YES," is decreased by the correctional amount σ at step S106 if the answer to the determination is "NO". After having altered the average correctional value cfbave at step S105 or step S106, another determination is made at step S107 as to whether the computation counter has counted the number of computation P grater than a specified count $P_0$. If the count P has not exceeded the specified count $P_0$, the routine returns without estimating the amount of trapped vapors. That is, the trapped vapor amount estimate subroutine does not conclude an estimate of the amount of trapper vapors when the average correctional value cfbave is not regarded to be stable.e. when the specified number of computation $P_0$ has not been made. On the other hand, if the count P has reached or exceeded the specified count $P_0$, another determination is made at step S108 as to whether the absolute value of average correctional value (|cfbavel) is greater than the specified reference value ε. If the absolute value of average correctional value (|cfbavel) is less than the specified reference value ε, this indicates that the estimate of the amount of trapper vapors is regarded to be completed and approximately agree with the actual amount of trapped vapors, then, the routine returns after setting the estimate completion flag xtraplrn to "1" (one) at step S109. On the other hand, if the absolute value of average correctional value (|cfbavel) is greater than the specified reference value ε, the routine returns.

As shown in FIG. 11 showing a curve G1 of the absolute value of average correctional value (|cfbavel), if the actual amount of trapped vapors trap is presumed to be at a level $a_2$, an estimate of the amount of trapped vapors trap is regarded to be completed when the estimated amount of trapped vapors trap falls between specified levels $a_1$ and $a_3$. In FIG. 11, the average correctional value cfbave takes a minus value for amounts less than the actual amount of trapped vapors at the level $a_2$ or takes a plus value for amounts greater than the actual amount of trapped vapors at the level $a_2$.

When the answer to the determination made at step S101 is "NO," this indicates that an engine operating condition does not meet at least one of the requirements, then, at step S110, the time counter changes its count ct down by 1 (one) to count a duration of interruption for which an estimate of the amount of trapped vapors trap remains continuously interrupted, and the computation counter is reset to 0 (zero). Subsequently, at step S111, a determination is made as to whether the time counter has counted down the count ct to 0 (zero), in other words whether a predetermined duration of interruption for which an estimate of the amount of trapped vapors trap remains continuously interrupted has passed. If the predetermined duration of interruption has passed, then, the routine returns after resetting the estimate completion flag xtraplrn to "0" at step S112. This is because there are apprehensions that the estimated amount of trapped vapors is different from the actual amount of trapped vapors. On the other hand, if the predetermined duration of interruption has not yet passed, the routine directly returns.

FIG. 12 shows changes of various control factors, such as a duty ratio (dpg) for the purge valve 29 represented by a curve G2, a correctional value cfb represented by a curve G3, an average correctional value cfbave represented by a curve G4, and the amount of trapped vapors trap represented by a curve G5 in the event where canister purge commences starts at a time $t_1$ during the trapped vapor amount estimating subroutine. As clearly understood from FIG. 12, shortly after a commencement of an estimate of the amount of trapped vapors trap at the time $t_1$, the estimated amount of trapped vapors trap converges at a fixed value. In this way, the amount of trapped vapors trap is precisely estimated.

Although a geometric mean value of correctional values cfb sampled for a regular interval is employed as the average correctional value cfbave at step S103 in the trapped vapor amount estimating subroutine, a weighted average value of correctional values cfb obtained from the following formula (II) may be employed as the average correctional value cfbave.

$$cfbave = W\alpha \cdot cfb(i) + (1 - W\alpha) \cdot cfb(i-1) \quad \text{(II)}$$

where Wα is the weighing factor;

cfbave is the average correctional value;

cfb(i) is the correctional value at the current estimate; and cfb(i−1) is the correctional value at the last estimate.

As was previously described, the control unit (ECU) 30 having a function of learning an air-to-fuel ratio is preferred to perform an estimate of the amount of trapped vapors trap after completion of the learning of air-to-fuel ratio.

Figure 6:
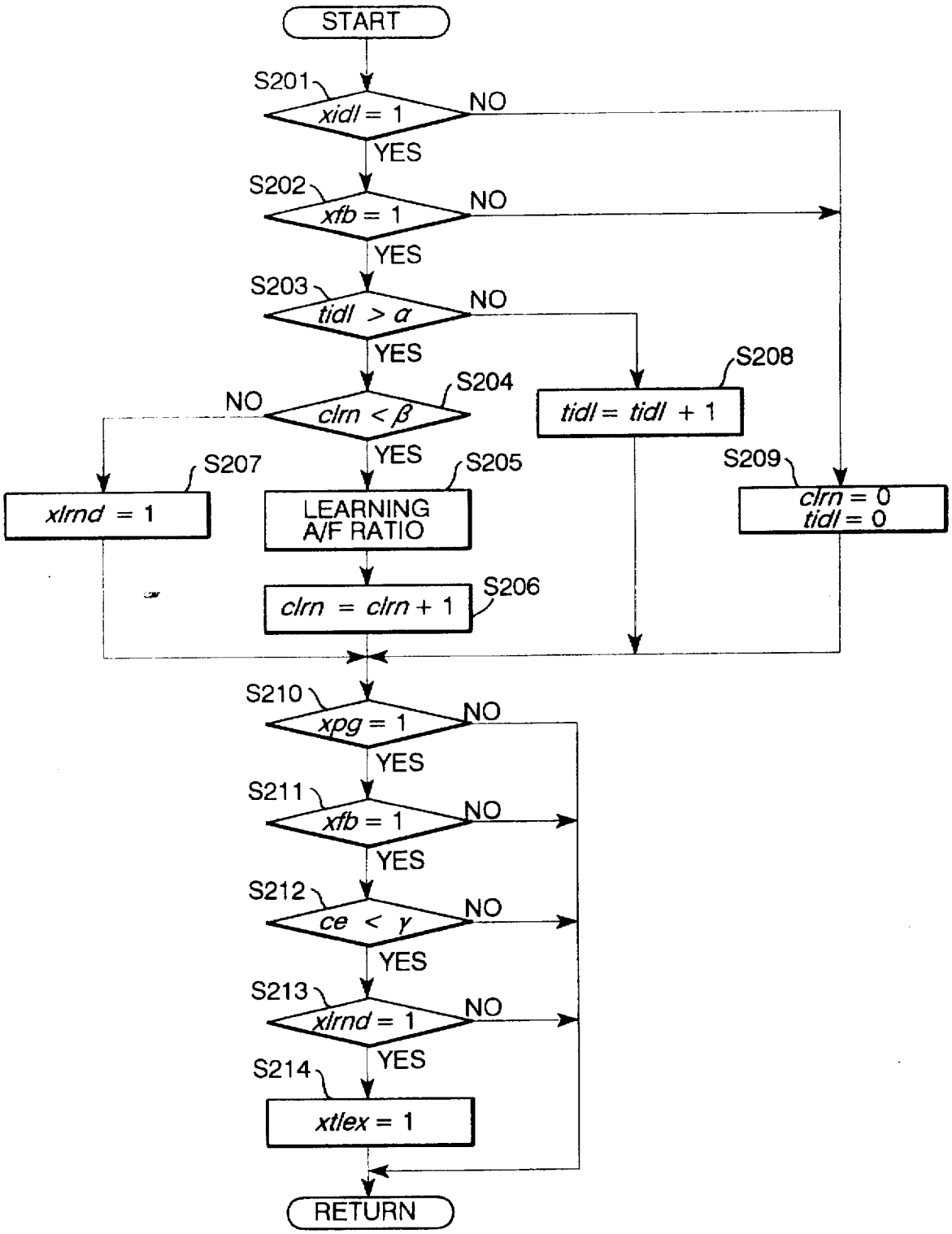
FIG. 6 is a flowchart illustrating a subroutine of judging of execution of an estimate of the amount of trapped fuel vapors.

FIG. 6 is a flowchart illustrating the subroutine which is called for at step S7 of the main routine illustrated in FIG. 4 to judge an engine operating condition for execution of an estimate of the amount of trapped vapors after completion of the learning control of air-to-fuel ratio. The flowchart logic commences and control passes directly to function block at S201 where a determination is made as to whether an idle flag xidl has been up or set to "1". The idle flag xidl is up or set to "1" during idling and down or reset to "0" during off-idling. If the idle flag xidl has been set to "1," this indicates that the engine CE or CE' is idling, then, determinations are consecutively made at steps S202 and S203 as to an air-to-fuel ratio control execution flag xfb and an idling time tidl, respectively. In this instance, the air-to-fuel ratio control execution flag xfb is up or set to "1" during execution of the air-to-fuel ratio feedback control and down or reset to "0" while the air-to-fuel ratio feedback control is not executed. The idling time tidl is a duration for which the engine CE or CE' is continuously idling and which is counted by a counter. When, while the answer to the determination made at step S202 is "YES," the answer to the determination made at step S203 is "NO," this indicates that the engine CE or CE' is idling for a time less than a specified time Tα during execution of the air-to-fuel ratio feedback control and, consequently, is regarded to be still in an unstable idling state, then, the learning control of air-to-fuel ratio is not executed. On the other hand, when the answer to the decision made at step S203 is "YES," this indicates that an engine operating condition meets requirements for execution of the learning control of air-to-fuel ratio, then, a determination is made at step S204 as to whether the number of times of execution of the learning control of air-to-fuel ratio (which is hereafter referred to as a learning control execution number clrn) is less than a specific number β. The learning control execution number clrn indicates a number of times of execution of the learning control of air-to-fuel ratio after commencement of idling and is counted by a counter. When the learning control of air-to-fuel ratio repeated frequently more than the specified number Tβ, it is decided that the learning control of air-to-fuel ratio has been appropriately completed. If the answer to the determination made at step S204 is "YES," this indicates that the learning control of air-to-fuel ratio has not yet been completed, then, while the learning control of air-to-fuel ratio is still continued at step S205, the learning control execution number clrn is changed by an increment of 1 (one) at step S206. On the other hand, if the answer to the determination made at step S204 is "NO," this indicates that the learning control of air-to-fuel ratio has been completed, then, the learning completion flag xlrnd is up or set to "1" (one) at step S207.

If the answer to the determination made at step S201 or S202 is "NO," this indicates that the engine operating condition does not meet the requirements for execution of the learning control of air-to-fuel ratio, then, the control subroutine avoids the learning control of air-to-fuel ratio through steps S203 to S207 and proceeds directly to step S209 where the counters reset their counts tidl and clrn to 0 (zero), respectively. Further, if the answer to the determination made at step S203 is "NO," this indicates that the engine operating condition does not meet the requirement of idling time tidl for execution of the learning control of air-to-fuel ratio, then, the control subroutine avoids the learning control of air-to-fuel ratio and proceeds directly to step S208 where the counter changes its count tidl by an increment of 1 (one). The learning control of air-to-fuel ratio is performed to control an injection pulse width for the injector 15 such that the correctional value cfb takes a neutral value of 0 (zero) on average when there is no air-to-fuel ratio deviation.

When the learning control of air-to-fuel ratio has been appropriately completed or when the engine operating condition does not meet any one of the requirements for execution of the learning control of air-to-fuel ratio, the control subroutine judges whether the engine operating condition meets all of the requirements (1) through (4) necessary to execute an estimate of the amount of trapped vapors as was mentioned previously. Specifically, determinations are consecutively made at steps S210 through S213 as to a purge execution flag xpg, the air-to-fuel ratio control execution flag xfb, an air charging efficiency ce and the learning completion flag xlrnd, respectively. When, while all of the flags xpg, xfb and xlrnd have been set to "1," the air charging efficiency ce remains less than a specified efficiently $\gamma$, this indicates that the engine operating condition meets all of the requirements for execution of a precise estimate of the amount of trapped vapors, then, the estimate condition flag xtlex is up or set to "1" at step S214, and the final step orders return. On the other hand, when the answer to the determination made at either one of steps S210 through S213 is "NO," this indicates that the engine operating condition does not satisfy the requirements, then, the final step orders return.

Figure 7:
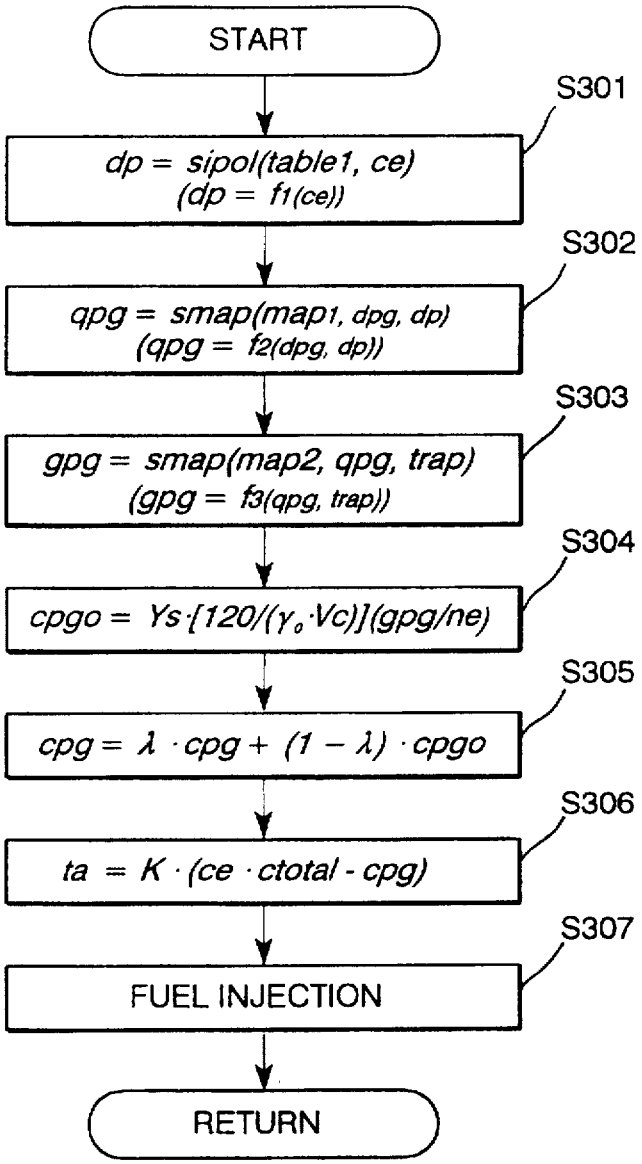
FIG. 7 is a flowchart illustrating a fuel injection amount computing subroutine.

FIG. 7 is a flowchart illustrating the subroutine of controlling fuel injection called for at step S4 of the main routine illustrated in FIG. 4. In this fuel injection control subroutine, both purged gas ratio and net purged gas ratio are computed to perform the fuel injection control. The flowchart logic commences and control passes directly to function block at S301 where a purge valve pressure difference dp is obtained based on a functional relationship (sipol) between purge valve pressure difference dp as a dependent variable and air charging efficiency ce as an independent variable which is provided in a form of a look-up table (table 1). Alternatively, a purge valve pressure difference dp may be computed directly from a function ($f_1$) including air charging efficiency ce as a variable. At step S302, a flow rate or amount of purged gas qpg (which contains fuel vapor and purge air) is obtained based on a functional relationship (smap) between purged gas flow rate qpg as a dependent variable and purge valve pressure difference dp and duty ratio dpg for the purge valve 29 as independent variables which is provided in a form of a look-up table or map (map 1). Alternatively, the purged gas flow rate qpg may be computed directly from a function ($f_2$) including purge valve pressure difference dp and duty ratio dpg as variables. Subsequently, at step S303, a drawn rate or amount of fuel vapors gpg is obtained based on a functional relationship (smap) between fuel vapor drawn rate gpg as a dependent variable and the purged gas flow rate qpg and the amount of trapped vapors trp as independent variables which is provided in a form of a look-up table or map (map 2). Alternatively, a drawn rate or amount of fuel vapors gpg may be computed directly from a function ($f_3$) including the purged gas flow rate qpg and the amount of trapped vapors trp as variables.

At step S304, a fuel purge ratio cpgo is computed from the following formula (III):

$$cpgo = Ys \cdot [120/(\gamma_0 \cdot Vc)] \cdot (gpg/ne) \quad \text{(III)}$$

where Ys is the transformation coefficient for a transformation of the amount of intake air to the amount of fuel injection;

$\gamma_0$ is the consistency of intake air;

Vc is the effective volume of cylinder; and ne is the rotational speed (r.p.m.) of engine.

In the formula (III), $120/(\gamma_0 \cdot Vc)$ is a reciprocal number of the amount (mass flow rate per second) of intake air introduced into the combustion chamber 4, and, consequently, $Ys \cdot [120/(\gamma_0 \cdot Vc \cdot ne]$ is a reciprocal number of the demanded amount of fuel per second. As apparent from the above discussion, the fuel purge ratio cpgo indicates a proportion or a contributory rate of fuel vapors drawn into the purge pipe 28 relative to the demanded amount of fuel.

At step S305, a net purged gas ratio cpg is computed from the following formula (IV):

$$cpg = \lambda \cdot cpg + (1-\lambda) \cdot cpgo \quad \text{(IV)}$$

where $\lambda$ is the first order of filter factor ($0<\lambda<1$).

The formula (IV) is a modeled formula representing a time delay in air and fuel vapor conveyance through the fuel vapor passage. By appropriately selecting the first order of filter factor according to configurations of the fuel vapor passage including the intake system 10, assist air control system 16 and purge pipe 28, the net purged gas ratio cpg is precisely computed from the formula (IV).

Subsequently, at step S306, an eventual fuel injection pulse width ta is computed from the following formula (V):

$$ta = K \cdot (ce \cdot ctotal - cpg) \quad \text{(V)}$$

where K is the transformation coefficient; and ctotal is the correctional coefficient.

Since K·ce·ctotal indicates a fuel injection pulse width in conformity with the demanded amount of fuel, and K·cpg indicates a fuel injection pulse width in conformity with the net amount of purged fuel vapors, the eventual fuel injection pulse width ta indicates the amount of fuel to be eventually injected from the injector 15.

At final step S307, the injector is pulsed to deliver fuel depending upon the eventual fuel injection pulse width ta.

Through this fuel injection control subroutine, an amount of fuel precisely controlled and delivered into the combustion chamber 4 according to an engine operating condition even while a canister purge is being executed, so that the control system provides a stoichiometric air-fuel mixture maintained at an ideally combustible air-to-fuel ratio. In this instance, because, while the process of determining the amount of fuel according to engine demands is performed in feedback control, the process of making fuel vapors purged from the canister 25 reflect on the demanded amount of fuel is performed in feed-forward control, there occurs no time delay in computations of the net purged gas ratio or the inflow rate of fuel vapors, and consequently, there is not caused a deviation of the A/f from the target air-to-fuel ratio due to purged fuel vapors. Because the eventual amount of fuel to be injected from the injector 15 is determined by subtracting from the demanded amount of fuel the net amount of fuel vapors flowing into the combustion chamber which is precisely computed on the basis of the amount of trapped vapors, fuel vapors introduced into the intake system 10 or the combustion chamber 4 do not act as a disturbance on the air-to-fuel ratio feedback control, and accordingly, there is not caused a deviation of the A/f from the target air-to-fuel ratio due to purged fuel vapors when an estimate of the amount of trapped vapors is completed.

As was previously mentioned, when a canister purge commences in a specific range of engine operating conditions, for instance engine idling during which only a small amount of fuel is needed, where the amount of intake air is small, the air-to-fuel ratio feedback control becomes unstable in operation easily. Further, in the event where a canister purge commences before completion of an estimate of the amount of trapped vapors or while the estimate completion flag xtraplrn remains down or reset to "0" and the net amount of fuel vapors or the amount of inflow fuel vapors is still inaccurate, the air-to-fuel ratio feedback control is unstable. For these reasons, the engine control system of the specific embodiment restricts or controls the canister purge to prevent unstable operation of the air-to-fuel ratio feedback control.

As shown in FIG. 13, in the event where a canister purge is commenced in a range of engine operating conditions for the air-to-fuel ratio feedback control, the purged gas flow rate is gradually increased to a target rate. The increasing rate of the purged gas flow rate is established lower in an idle range of engine operating conditions where the amount of intake air is small than in an off-idling range of engine operating conditions where the amount of intake air is large. In both on-idling and off-idling ranges of engine operating conditions, the increasing rate is established lower before completion of an estimate of the amount of trapped vapor than after completion of an estimate of the amount of trapped vapors. Together, the increasing rate is established lower after completion of an estimate of the amount of trapped vapors in the idling range of engine operating conditions than before completion of an estimate of the amount of trapped vapors in the off-idling range of engine operating conditions.

In FIG. 13, lines $J_1$ and $J_2$ indicate a change in duty ratio for the purge valve 29, i.e. the increasing rate, relative to time for cases where an estimate of the amount of trapped vapors has been completed in the off-idling range and cases where an estimate of the amount of trapped vapors has not yet been completed in the off-idling range, respectively. Similarly, lines $J_3$ and $J_4$ indicate a change in duty ratio for the purge valve 29, i.e. the increasing rate, relative to time for cases where an estimate of the amount of trapped vapors has been completed in the idling range and cases where an estimate of the amount of trapped vapors has not yet been completed in the idling range, respectively. In FIG. 13, a target duty ratio (a target purged gas flow rate) in the off-idling range is indicated by $d_1$, and a target duty ratio in the idling range is indicated by $d_2$.

As described above, because the amount of fuel vapor purge gradually increases after commencement of a canister purge, the amount of fuel vapors entering the intake system 10 does not significantly increase at the beginning of the fuel vapor purge, and, as a result, the air-to-fuel ratio feedback control is prevented from encountering unstable operation during a canister purge and provides reliable responsiveness. Since the target amount of fuel vapors is reached after a while from commencement of the canister purge, fuel vapors trapped in the canister 25 are swiftly discharged into the intake system 10. This permits to install a small-sized canister 25 in the vapor trapping system 24 with the effect of ensuring stable and high responsive operation of the air-to-fuel ratio feedback control and providing an increase in the amount of purged fuel vapors. As a result, the vapor trapping system 24 provides improvement of fuel efficiency. Together, since the increasing rate is small when an estimate of the amount of trapped vapors has not been completed, the air-to-fuel ratio feedback control is prevented from encountering unstable operation at the beginning of the canister purge even when the amount of trapped vapors, and hence the amount of purged fuel vapors, has not yet precisely known.

Figure 8:
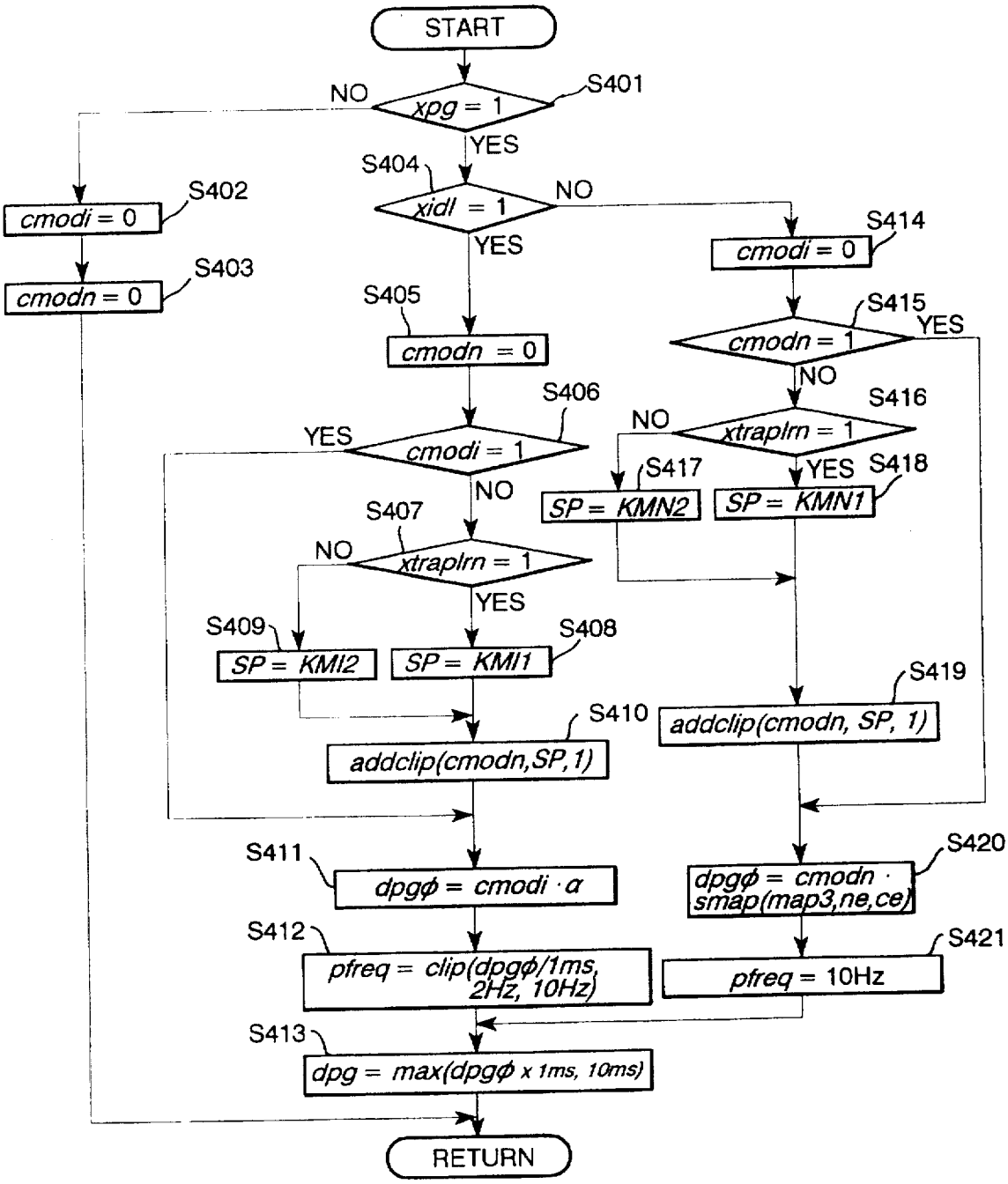
FIG. 8 is a flowchart illustrating a purge amount computing subroutine.

FIG. 8 is a flowchart illustrating the subroutine of computing the purged gas flow rate called for at step S6 of the main routine illustrated in FIG. 4. In the purged gas flow rate computing subroutine, the duty ratio for the purge valve is controlled to gradually increase at a changing rate at the beginning of a canister purge. The flowchart logic commences and control passes directly to function block at S401 where a determination is made as to whether the purge execution flag xpg has been up or set to "1". If the purge execution flag xpg is down, both duty ratio correctional values cmodi and cmodn for on-idling purge correction and off-idling purge correction are reset to 0 (zero) at steps S402 and S403, respectively. The duty ratio is gradually increased by the correctional value cmodi or cmodn toward the target duty ratio. The duty ratio dpgϕ at which the purge valve 29 is activated is represented by the product of the target duty ratio and the correctional value cmodi or cmodn. Each of the correctional values cmodi and cmodn takes a value between 0 (zero) and 1 (one). In particular, each of the correctional values cmodi and cmodn takes a value of 0 (zero) before commencement of a canister purge and is continuously increased by increments of a specified value SP to the limit value of 1 (one) during the canister purge to provide a gradual increase in the purge air flow rate. When the correctional value cmodi or cmodn has reached a value of 1 (one), it does not vary any more and holds the limit value of 1 (one). When the correctional value cmodi or cmodn takes a value of 0 (zero), a canister purge is interrupted irrespective of the target duty ratio.

When the purge execution flag xpg is up, a determination is made at step S404 as to the idle flag xidl. If the idle flag xidl has been down, this indicates that the engine CE or CE' is under off-idling, then, after resetting the on-idling correctional value cmodi to a value of 0 (zero) at step S414, a determination is made at step S415 as to the off-idling correctional value cmodn. When the off-idling correctional value cmodn is still less than the limit value of 1 (one), this indicates a state where the off-idling correctional value cmodn must be gradually increased, then, a gradual increase in the off-idling correctional value cmodn is made in consideration of completion of an estimate of the amount of trapped vapors between steps S416 through S415. Specifically, a determination is made at step S416 as to whether the estimate completion flag xtraplrn has been up or set to "1". When the answer to the decision is "YES," this indicates that the estimate completion flag xtraplrn has been up, then, the increment value SP is substituted by a relatively greater value KMN1 at step S418. In this event where an estimate of the amount of trapped vapors has been completed, the net purged gas ratio or the amount of inflow fuel vapors is precisely computed and consequently, influences of the canister purge is reliably eliminated by the feed-forward air-to-fuel ratio control. That is, even when a canister purge is somewhat quickly commenced, influences of the canister purge is sufficiently limited, and the air-to-fuel ratio feedback control is prevented from encountering unstable operation. For the reasons, the increment value SP is changed at step S418 to increase the increasing rate of the off-idling correctional value cmodn in order to perform the canister purge at the target duty ratio (as indicated by a line J1 in FIG. 13) in earliest stage.

On the other hand, when the answer to the decision is "NO," this indicates that the estimate completion flag xtraplrn has not yet been up, then, the increment value SP is substituted by a relatively smaller value KMN2, which is smaller than the substitutive value KMN1, at step S417. In this event where an estimate of the amount of trapped vapors has not yet been completed, the net purged gas ratio or the amount of inflow fuel vapors is hard to be precisely computed and consequently, the feed-forward air-to-fuel ratio control does not appropriately operate. Consequently, somewhat quick commencement of a canister purge produces an adverse effect on the air-to-fuel ratio control. For the reasons, the increment value SP is changed at step S417 to decrease the increasing rate of the off-idling correctional value cmodn (as indicated by a line J2 in FIG. 13).

After changing the increment value SP at step S417 or S418, a current off-idling correctional value cmodn is obtained by adding the increment value SP to the last off-idling correctional value cmodn at step S419. The current off-idling correctional value cmodn is however clipped or limited to 1 (one) at the greatest. In this way, the off-idling correctional value cmodn is gradually increased. Subsequently, the duty ratio dpgϕ (%) at which the purge valve 29 is activated is computed at step S420 by use of the following formula (VI):

$$dgp\phi = cmodn \cdot smap(map3, ne, ce) \quad \text{(VI)}$$

where smap(map3, ne, ce) is the off-idling target duty ratio (%).

In the above formula (VI), smap means a functional relationship between duty ratio dpgϕ as a dependent variable and engine speed ne and air charging efficiency ce as an independent variable which is provided in a form of a duty ratio map (map3). In this way, the duty ratio dpgϕ is gradually increased after commencement of the canister purge.

When the answer to the determination made at step S415 is "YES," this indicates that the off-idling correctional value cmodn has reached the limit value of 1 (one), then, the control proceeds directly to step S420 to compute the duty ratio dpgϕ by use of the off-idling correctional value cmodn of 1 (one).

After the computation of the duty ratio dpgϕ at step S420, a operating frequency pfreq is fixed at 10 Hz at step S421. That is, the purge valve 29 is activated once every 100 milliseconds. In this event, as was previously described, a time for which the purge valve 29 remains open is varied according to the duty ratio dpgϕ.

On the other hand, when the answer to the determination made at step S404 as to the idle flag xidl is "YES," this indicates that the engine is idling, then, after resetting the off-idling correctional value cmodn to 0 (zero) at step S405, a determination is made at step S406 as to the on-idling correctional value cmodi. When the on-idling correctional value cmodi is still less than the limit value of 1 (one), this indicates a state where the on-idling correctional value cmodi must be gradually increased, then, a gradual increase in the on-idling correctional value cmodi is made in consideration of completion of an estimate of the amount of trapped vapors between steps S407 through S410. Specifically, a determination is made at step S407 as to whether the estimate completion flag xtraplrn has been up or set to "1". When the answer to the decision is "YES," this indicates that the estimate completion flag xtraplrn has been up, then, the increment value SP is substituted by a relatively greater value KMI1, which is smaller than the substitutive value KMN2, at step S408. In this event where an estimate of the amount of trapped vapors has been completed, the net gas purge rate or the amount of inflow fuel vapors is precisely computed and consequently, influences of the canister purge is reliably eliminated by the feed-forward air-to-fuel ratio control. In other words, even when a canister purge is somewhat quickly commenced, influences of the canister purge is sufficiently eliminated, and the air-to-fuel ratio feedback control is prevented from encountering unstable operation. For the reasons, the increment value SP is changed at step S408 to increase the increasing rate of the off-idling correctional value cmodi in order to perform the canister purge at the target duty ratio (as indicated by a line J1 in FIG. 13) in earliest stage. Because, a less amount of fuel injection is required during idling, and consequently, the air-to-fuel ratio feedback control is apt to encounter unstable operation, the increment value SP is substituted by the on-idling correctional value KMI1 after completion of an estimate of the amount of trapped vapors smaller than the off-idling correctional value KMN2 before completion of an estimate of the amount of trapped vapors.

On the other hand, when the answer to the determination made at step S407 is "NO," this indicates that the estimate completion flag xtraplrn has not yet been up, then, the increment value SP is substituted by a value KMI2, which is relatively smaller than the value KMI1, at step S409. In this event where an estimate of the amount of trapped vapors has not yet been completed, the net purged gas ratio or the amount of inflow fuel vapors is hard to be precisely computed, and consequently, the feed-forward air-to-fuel ratio control does not appropriately operate. As a result, quick commencement of a canister purge produces an adverse effect on the air-to-fuel ratio control. For the reasons, the increment value SP is changed at step S417 to decrease the increasing rate of the on-idling correctional value cmodi.

After changing the increment value SP at step S408 or S409, a current on-idling correctional value cmodi is obtained by adding the increment value SP to the last on-idling correctional value cmodi at step S410. The current on-idling correctional value cmodi is however clipped or limited to at the greatest 1 (one). In this way, the on-idling correctional value cmodi is gradually increased. Subsequently, the duty ratio dpgϕ (%) is computed at step S411 by use of the following formula (VII):

$$dgp\phi = cmodi \cdot \alpha \quad \text{(VII)}$$

where α is the on-idling target duty ratio (%).

When the answer to the determination made at step S406 is "YES," this indicates that the on-idling correctional value cmodi has reached the limit value of 1 (one), then, the control proceeds directly to step S411 to compute the duty ratio dpgϕ by use of the on-idling correctional value cmodi of 1 (one).

After the computation of the duty ratio dpgϕ at step S411, an operating frequency pfreq on which the purge valve 29 is operated is computed from the following formula (VII) at step S412.

$$pfreq = clip(dpg\phi/1\ ms \cdot 2\ Hz,\ 10\ Hz) \quad \text{(VIII)}$$

The operating frequency pfreq given by the formula (VIII) is basically dependent upon the duty ratio dpgϕ and, however, clipped or limited to at the greatest 10 Hz and at the least 2 Hz. For instance, the operating frequency pfreq is 10 Hz for duty ratios dpgϕ between 0 and 2%, 3 Hz for a duty ratio dpgϕ of 3%, and 10 Hz for a duty ratio dpgϕ of 20%.

After determination of the operating frequency pfreq at step S412 or 421, a valve duration dpg which is the length of time, measured in seconds, that the purge valve 29 remains turned on is computed from the following formula (IX) at step S413:

$$dpg = max(dpg\phi \cdot 1\ ms,\ 10\ ms) \quad \text{(IX)}$$

The valve duration dpg given by the formula (IX) takes either one of the duty ratio dpgϕ·1 ms and 10 milliseconds which is greater than the other.

Apparent from the formula (IX), the operating frequency pfreq is fixed at 10 Hz (operating period is 100 milliseconds) for duty ratios dpgϕ greater than 10%, and the valve duration dpg has the same value as the duty ratio dpgϕ. On the other hand, the valve duration dpg is fixed at 10 milliseconds for duty ratios dpgϕ less than 10%, and the operating frequency pfreq has the same value as the duty ratios dpgϕ and, however, exceeds the lower limit of 2 Hz. The operating frequency pfreq of, for instance, 10 Hz (operating period of 100 milliseconds) for a duty ratio dpgϕ of 30% provides a valve duration of 30 milliseconds. The operating frequency pfreq of, for instance, 3 Hz (operating period is 333 milliseconds) for a duty ratio dpgϕ of 3% provides a valve duration of 10 milliseconds.

As shown by line J5 in FIG. 14, the duty ratio dpgϕ is fixed at 2% between times $\theta_1$ and $\theta_2$ and increases at a specified rate after the time $\theta_2$. Further, the duty ratio dpgϕ reaches 10% at a time $\theta_3$, and attains and remains a fixed ratio greater than 10%. As shown by line J6, the operating frequency pfreq varies following the change in the duty ratio dpgϕ.

In the fuel vapor amount computing subroutine, in order to quicken commencement of a canister purge, the off-idling correctional value cmodn may be given a small value of, for instance, 0.125 in place of 0 (zero) at steps S402, S403, S405 and S414.

Figure 9:
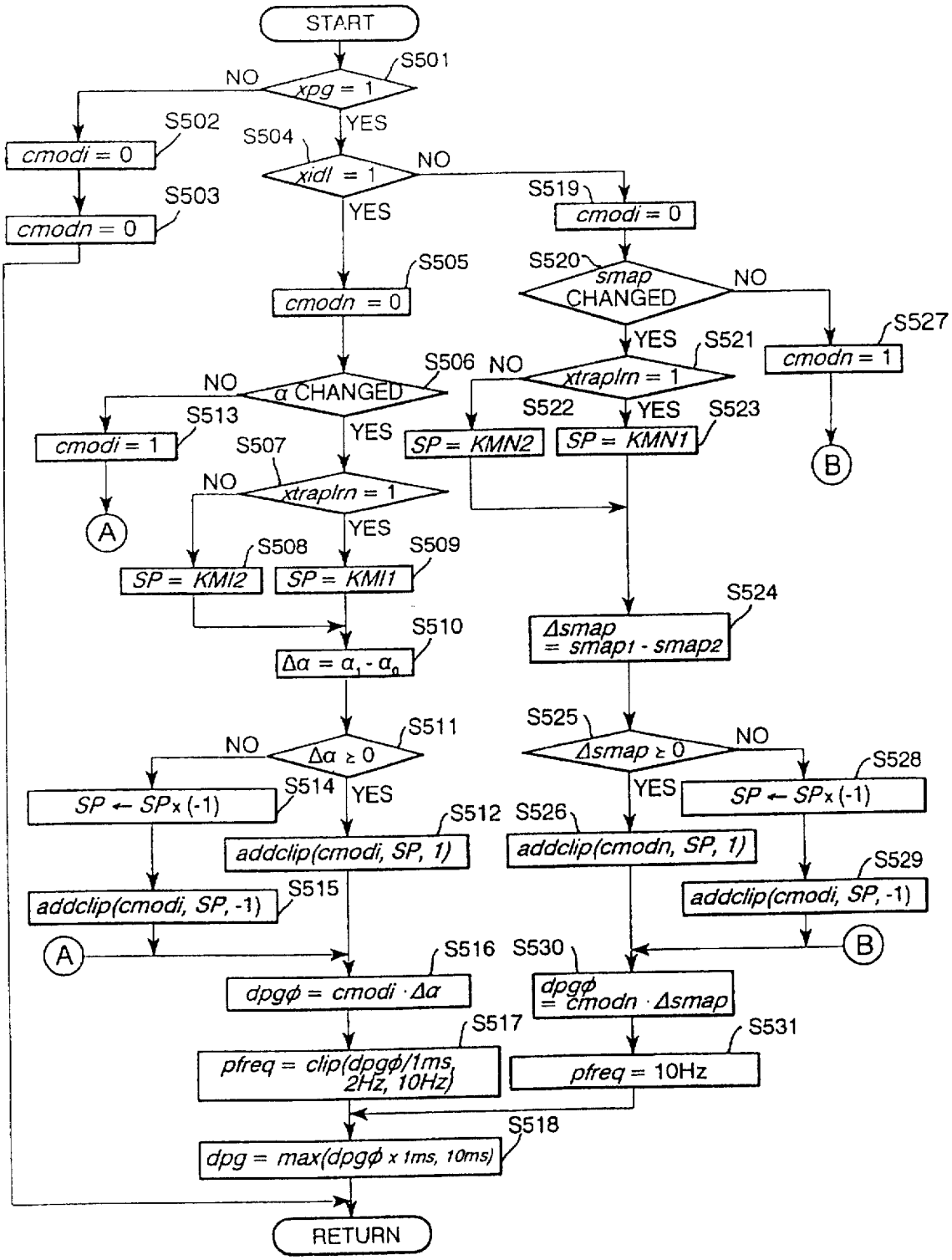
FIG. 9 is a flowchart illustrating a subroutine of judging of execution of a canister purge.

FIG. 9 is a flowchart illustrating a variant of the fuel vapor amount computing subroutine of FIG. 8, in which the duty ratio dpgϕ is increasingly or decreasingly changed according to variations of the target duty ratio. The flowchart logic commences and control passes directly to function block at S501 where a determination as to the purge execution flag xpg is made. When the purge execution flag xpg has been down, both on-idling correctional value cmodi and off-idling correctional value cmodn are reset to 0 (zero) at steps S502 and S503, respectively. On the other hand, when the purge execution flag xpg is up, a determination as to the idle flag xidl is subsequently made at step S604. When the idle flag xidl has been down, after resetting the on-idling correctional value cmodi to a value of 0 (zero) at step S519, a determination is made at step S520 as to whether there has been a change in the off-idling target duty ratio smap due to a change in engine operating conditions including at least engine speed and engine load. When there has been a change in the off-idling target duty ratio smap, a determination is made at step S521 as to whether the estimate completion flag xtraplrn has been up. When the answer to the decision is "YES," this indicates that the estimate completion flag xtraplrn has been up, then, the increment value SP is substituted by a relatively greater value KMN1 at step S523. On the other hand, when the answer to the decision has been is down, the increment value SP is substituted by a relatively smaller value KMN2, which is smaller than the substitutive value KMN1, at step S522. After changing the increment value SP at step S522 or S523, the target duty ratio difference Δsmap between the current off-idling target duty ratio $smap_1$ and the last off-idling target duty ratio $smap_0$ at step S524. When the current off-idling target duty ratio $smap_1$ is greater than the last off-idling target duty ratio $smap_0$, the off-idling correctional value cmodn is obtained by adding the increment value SP to the last off-idling correctional value cmodn at step S526. The current off-idling correctional value cmodn is however clipped or limited to 1 (one) at the greatest. In this way, the off-idling correctional value cmodn is gradually increased. Subsequently, at step S530, the duty ratio dpgϕ (%) at which the purge valve 29 is activated is computed by use of the following formula (X):

$$dgp\phi = cmodn \cdot \Delta smap \quad (X)$$

When the answer to the determination as to the target duty ratio difference Δsmap made at step S525 is "NO," this indicates that the current off-idling target ratio difference is less than the last off-idling target duty ratio $smap_0$, then, after inverting the increment value SP at step S528, the off-idling correctional value cmodn is obtained by adding the decrement value −SP to the last off-idling correctional value cmodn at step S529. The current off-idling correctional value cmodn is however clipped or limited to minus 1 (one) at the least. In this way, the off-idling correctional value cmodn is gradually decreased. Subsequently, at step S530, the duty ratio dpgϕ (%) is computed by use of the formula (X).

When there is no change in the off-idling target duty ratio smap, after fixing the off-idling correctional value cmodn at 1 (one) at step S527, the duty ratio dpgϕ (%) is computed by use of the formula (X).

After the computation of the duty ratio dpgϕ at step S420, a operating frequency pfreq is fixed at 10 Hz at step S531.

On the other hand, when the answer to the determination made at step S504 as to the purge execution flag xpg is "YES," this indicates that the engine is idling, then, after resetting the off-idling correctional value cmodn to 0 (zero) at step S505, a determination is made at step S506 as to whether there has been a change in the on-idling target duty ratio α due to a change in engine operating condition, in particular a change in air-to-fuel ratio. When there has been a change in the on-idle target duty ratio α, a determination is made at step S507 as to whether the estimate completion flag xtraplrn has been up. When the answer to the decision is "YES," the increment value SP is substituted by a relatively greater value KMI1 at step S509. On the other hand, when the answer to the decision has been is down, the increment value SP is substituted by a relatively smaller value KMI2 at step S508. After changing the increment value SP at step S508 or S509, the target duty ratio difference Δα between the current on-idling target duty ratio $\alpha_1$ and the last on-idling target duty ratio $\alpha_0$ at step S510. When the current on-idling target duty ratio $\alpha_1$ is greater than the last on-idle target duty ratio $\alpha_0$, the on-idling correctional value cmodi is obtained by adding the increment value SP to the last on-idling correctional value cmodi at step S512. The on-idling correctional value cmodi is however clipped or limited to 1 (one) at the greatest. In this way, the off-idling correctional value cmodi is gradually increased. Subsequently, at step S530, the duty ratio dpgϕ (%) at which the purge valve 29 is activated is computed by use of the following formula (XI):

$$dgp\phi = cmodi \cdot \Delta\alpha \quad (XI)$$

When the current on-idling target ratio $\alpha_1$ is less than the last on-idling target duty ratio $\alpha_0$, i.e. the on-idling target duty ratio difference Δα is less than 0 (zero), then, after inverting the increment value SP at step S514, the on-idling correctional value cmodi is obtained by adding the decrement value −SP to the last on-idling correctional value cmodi at step S515. The current on-idling correctional value cmodi is however clipped or limited to minus 1 (one) at the least. In this way, the on-idling correctional value cmodi is gradually decreased. On the basis of the on-idling correctional value cmodi thus obtained at step S512, the duty ratio dpgϕ (%) is computed by use of the formula (XI) at step S516.

When there is no change in the on-idling target duty ratio α, after fixing the on-idling correctional value cmodi at 1 (one) at step S513, the duty ratio dpgϕ (%) is computed by use of the formula (XI) at step S516.

On the basis of the duty ratio dpgϕ computed at step S516, an operating frequency pfreq is computed from the following formula (VIII) at step S517. As was previously described, the operating frequency pfreq given by the formula (VIII) is basically dependent upon the duty ratio dpgϕ and, however, clipped or limited to at the greatest 10 Hz and at the least 2 Hz.

Subsequently to the computation of the operating frequency pfreq at step S517 or S531, a valve duration dpg is computed from the following formula (IX) at step S518.

Figure 10:
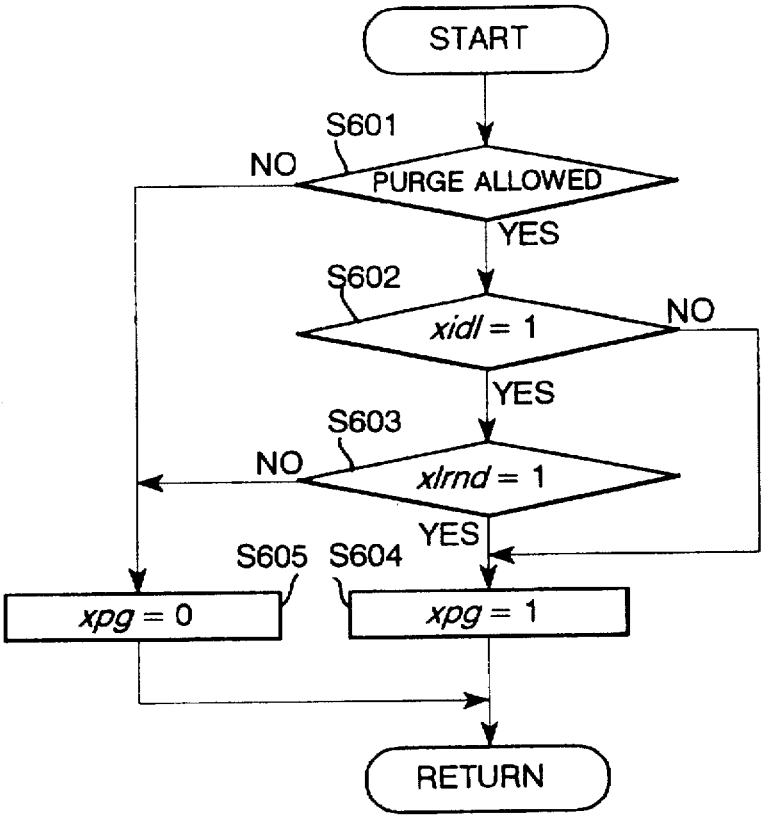
FIG. 10 is a flowchart illustrating a variation of the subroutine of judging of execution of a canister purge of FIG. 9.

FIG. 10 is a flowchart illustrating the subroutine which is called for at step S5 of the main routine illustrated in FIG. 4 to judge execution of an canister purge. The flowchart logic commences and control passes directly to function block at S601 where a determination is made as to whether an engine operating condition meets requirements for execution of a canister purge. In this instance, execution of a canister purge is allowed when an engine operating condition is within the range where the air-to-fuel ratio feedback control is executed or an air-fuel mixture is enriched at the temperature of engine cooling water higher than, for instance, 80° C. When the answer to the determination is "YES," a determination is made as to the idle flag xidl at step S602. When the idle flag xidl has been up, this indicates that the engine is idling, then, a determination is made as to the learning completion flag xlrnd at step S603. When the answer to the determination is "YES," this indicates that the air-to-fuel ratio learning has been completed while the engine is idling, then, the purge execution flag xpg is up at step S604 to allow execution of a canister purge. When the idle flag xidl is down, the routine proceeds to step S604 to set up the purge execution flag xpg to allow execution of a canister purge.

On the other hand, when the answer to at least one of the determinations made at step S601 and S603 is "NO," the purge execution flag xpg is down at step S606 to prohibit execution a canister purge.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A control system for an engine equipped with an intake system and a canister purge system which forces purged gas containing fuel vapors from a canister to enter into the intake system in a specific range of engine operating conditions, said control system comprises:

an air-to-fuel ratio detection sensor for detecting an air-to-fuel ratio of an air-fuel mixture;

fuel injection control means for feedback controlling an amount of fuel injection to bring said air-to-fuel ratio to a target ratio in said specified range of engine operating conditions; and purge control means for gradually varying a purged gas flow rate, at which a canister purge is performed, at a changing rate so as to attain a target purged gas flow rate determined according to engine operating conditions after commencement of a canister purge, said changing rate being smaller in an engine operating range of small amounts of intake air than in an engine operating range of large amounts of intake air.

2. A control system as defined in claim 1, wherein said purge control means gradually increases said purged gas flow rate at said changing rate to bring said purged gas rate toward said target rate.

3. A control system as defined in claim 1, wherein said purge control means gradually decreases said purged gas flow rate at a changing rate to bring said purged gas rate toward said target rate.

4. A control system as defined in claim 1, wherein said purge control means includes a purge control duty solenoid valve, and said purged gas flow rate is controlled by a duty ratio at which said purge control duty solenoid valve is activated.

5. A control system as defined in claim 1, further comprising:

fuel injection control means for determining a basic amount of fuel injection according to an amount of intake air, providing a correctional feedback value according to a deviation of said air-to-fuel ratio from said target ratio, determining a demanded amount of fuel injection on the basis of said basic amount of fuel injection and said correctional feedback value, estimating an amount of purged fuel vapors drawn from said canister on the basis of said correctional feedback value, and feedback controlling a fuel mixture setting according to a difference between said demanded amount of fuel and said estimated amount of purged fuel vapors so as to bring said air-to-fuel ratio to said target ratio in said specified range of engine operating conditions;

wherein said purge control means gradually varies said purged gas flow rate so as to attain said target purged gas flow rate determined according to engine operating conditions after commencement of said canister purge during idling, said changing rate being smaller before completion of said estimate of said amount of purged fuel vapors than after completion of said estimate of said amount of purged fuel vapors.

6. A control system as defined in claim 5, wherein said purge control means gradually increases said purged gas flow rate at said changing rate to bring said purged gas flow rate toward said target rate.

7. A control system as defined in claim 5, wherein said purge control means estimates said amount of purged fuel vapors on the basis of an amount of fuel vapors trapped in said canister.

8. A control system as defined in claim 5, wherein said purge control means estimates said amount of purged fuel vapors on the basis of an average correctional feedback value and updating said amount of purged fuel vapors in learning control.

9. A control system as defined in claim 5, wherein said purge control means includes a canister purge valve activated to turn on and off at a duty ratio according to said purged gas flow rate.

10. A control system as defined in claim 9, wherein said purge control means causes said canister purge valve to remain turned on for a fixed period of time and varies a frequency of activation of said canister purge valve according to said duty ratio when said duty ratio is less than a specified rate.

* * * * *